US012031755B2

(12) United States Patent
Catano-Montoya

(10) Patent No.: US 12,031,755 B2
(45) Date of Patent: Jul. 9, 2024

(54) REFRIGERATION SYSTEM HAVING HIGH-EFFICIENCY LOOP

(71) Applicant: Copeland LP, Sidney, OH (US)

(72) Inventor: Juan E. Catano-Montoya, Detroit, MI (US)

(73) Assignee: Copeland LP, Sidney, OH (US)

( * ) Notice: Subject to any disclaimer, the term of this patent is extended or adjusted under 35 U.S.C. 154(b) by 172 days.

(21) Appl. No.: 17/324,696

(22) Filed: May 19, 2021

(65) Prior Publication Data

US 2022/0373235 A1 Nov. 24, 2022

(51) Int. Cl.

| | |
|---|---|
| ***F25B 25/00*** | (2006.01) |
| ***F25B 29/00*** | (2006.01) |
| ***F25B 39/02*** | (2006.01) |
| ***F25B 41/20*** | (2021.01) |
| ***F25B 41/42*** | (2021.01) |
| ***F25B 49/00*** | (2006.01) |

(52) U.S. Cl.

CPC ..... *F25B 25/005* (2013.01); *F25B 29/003* (2013.01); *F25B 39/022* (2013.01); *F25B 41/20* (2021.01); *F25B 41/42* (2021.01); *F25B 49/00* (2013.01); *F25B 2339/022* (2013.01); *F25B 2400/12* (2013.01); *F25B 2600/2507* (2013.01)

(58) Field of Classification Search

CPC .... F25B 25/005; F25B 29/003; F25B 39/003; F25B 41/20; F25B 41/42; F25B 49/00; F25B 2339/022; F25B 2400/12; F25B 2600/2507

See application file for complete search history.

(56) References Cited

U.S. PATENT DOCUMENTS

| | | | |
|---|---|---|---|
| 4,197,719 A | 4/1980 | Shaw | |
| 5,355,688 A | 10/1994 | Rafalovich et al. | |
| 5,497,629 A | 3/1996 | Rafalovich et al. | |
| 5,678,626 A | 10/1997 | Gilles | |

(Continued)

FOREIGN PATENT DOCUMENTS

| | | | | |
|---|---|---|---|---|
| CN | 207974880 U | * | 10/2018 | ..... F01P 5/10 |
| CN | 110529628 A | * | 12/2019 | ..... B60H 1/00392 |
| WO | WO-2020-209979 A2 | | 10/2020 | |

OTHER PUBLICATIONS

Chen (CN110529628A), Multi-way valve, thermal management system and electric automobile, Dec. 13, 2019, Whole Document (Year: 2019).*

(Continued)

*Primary Examiner* — Larry L Furdge
*Assistant Examiner* — Keith Stanley Myers
(74) *Attorney, Agent, or Firm* — Harness, Dickey & Pierce, P.L.C.

(57) ABSTRACT

A refrigeration system includes a main fluid loop and a secondary fluid loop. The main fluid loop includes a compressor and a heat exchanger that circulate a first working fluid. The secondary fluid loop circulates a second working fluid. The secondary fluid loop is in thermal communication with the main fluid loop at the heat exchanger. The secondary fluid loop includes a pump, a thermal energy storage, and a coil fluid line. The secondary fluid loop includes a multi-position valve configured to move between positions that selectively fluidly connect the heat exchanger, the pump, the thermal energy storage, and the coil fluid line.

17 Claims, 22 Drawing Sheets

(56) References Cited

U.S. PATENT DOCUMENTS

| | | | | |
|---|---|---|---|---|
| 5,680,898 | A | 10/1997 | Rafalovich et al. | |
| 5,755,104 | A | 5/1998 | Rafalovich et al. | |
| 7,421,846 | B2 | 9/2008 | Narayanamurthy et al. | |
| 8,181,470 | B2 | 5/2012 | Narayanamurthy et al. | |
| 8,707,723 | B2 | 4/2014 | Narayanamurthy | |
| 9,581,265 | B2 | 2/2017 | Sherbeck et al. | |
| 10,180,257 | B2 | 1/2019 | Cur et al. | |
| 10,197,306 | B2 | 2/2019 | Li et al. | |
| 10,830,503 | B2 | 11/2020 | Kopko | |
| 2005/0120733 | A1 | 6/2005 | Healy et al. | |
| 2009/0293507 | A1 | 12/2009 | Narayanamurthy et al. | |
| 2011/0232320 | A1 | 9/2011 | Satou | |
| 2011/0308762 | A1* | 12/2011 | Spero | F24S 60/10 165/10 |
| 2016/0238265 | A1 | 8/2016 | Sherbeck et al. | |
| 2017/0152957 | A1 | 6/2017 | Roche et al. | |
| 2018/0363965 | A1* | 12/2018 | Hayamizu | F25B 31/008 |
| 2019/0107300 | A1 | 4/2019 | Locke et al. | |
| 2019/0285318 | A1 | 9/2019 | Kopko | |
| 2019/0309993 | A1* | 10/2019 | Zaynulin | F24T 10/00 |
| 2023/0030270 | A1* | 2/2023 | Andersson | F25B 39/02 |

OTHER PUBLICATIONS

Lee (CN207974880U), One-piece type multiple unit valve device of water pump for vehicle, English Translation, Oct. 16, 2018, Whole Document (Year: 2018).*

Carrier, Optimal Cooling or Optimized Savings?, Mar. 2017.

Khushairi et al, A Study on the Optimization of Control Strategy of a Thermal Energy Storage System for Building Air-Conditioning, 2011.

International Search Report and Written Opinion of the ISA for PCT/US2022/029616, ISA/KR, mailed Aug. 30, 2022.

* cited by examiner

REFRIGERATION SYSTEM HAVING HIGH-EFFICIENCY LOOP

FIELD

The present disclosure relates to a high-efficiency loop for a refrigeration system, and, more specifically, to a high-efficiency loop having a heat pump system and a valve.

BACKGROUND

A residential or light commercial HVAC (heating, ventilation, and air conditioning) system controls temperature and humidity of a building. Upper and lower temperature limits may be specified by an occupant or owner of the building, such as an employee working in the building or a homeowner. A thermostat controls operation of the HVAC system based on a comparison of measured air temperature and a target value. The thermostat controls the HVAC system to heat the building when the temperature is less than the lower temperature limit. The thermostat controls the HVAC system to cool the building when the temperature is greater than the upper temperature limit.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An example refrigeration system according to the present disclosure includes a main fluid loop and a secondary fluid loop. The main fluid loop includes a compressor and a heat exchanger that circulate a first working fluid. The secondary fluid loop circulates a second working fluid. The secondary fluid loop is in thermal communication with the main fluid loop at the heat exchanger. The secondary fluid loop includes a pump, a thermal energy storage, and a coil fluid line. The secondary fluid loop includes a multi-position valve configured to move between positions that selectively fluidly connect the heat exchanger, the pump, the thermal energy storage, and the coil fluid line.

The secondary fluid loop may be a heating secondary fluid loop, the thermal energy storage may be a hot thermal energy storage, the coil fluid line may be a heating coil fluid line, and the heat exchanger may be a condenser.

The example refrigeration system may include a cooling secondary fluid loop that circulates a third working fluid. The cooling secondary fluid loop may include a pump, a cold thermal energy storage, and a cooling coil fluid line. The main fluid loop may include an evaporator circulating the first working fluid. The cooling secondary fluid loop may be in thermal communication with the main fluid loop at the evaporator.

The cooling secondary fluid loop may include a multi-position valve configured to rotate between positions that selectively fluidly connect the evaporator, the pump, the cold thermal energy storage, and the cooling coil fluid line.

The example refrigeration system may include a connection valve, an indoor coil, and an outdoor coil. The connection valve may selectively connect the heating coil fluid line and the cooling coil fluid line with the indoor coil and the outdoor coil.

The second working fluid may be the same as the third working fluid.

The first working fluid may be different from the second working fluid.

The first working fluid may be different from the second working fluid.

The first working fluid may include a low global warming potential (LGWP) refrigerant.

The second working fluid may include a non-flammable refrigerant.

The heat exchanger may be a brazed-plate heat exchanger.

An example multi-position valve according to the present disclosure directs fluid flow in a secondary fluid loop of a refrigeration system. The example multi-position valve includes an actuator, a plurality of passages, a pump inlet, and a pump outlet. The actuator is configured to rotate the plurality of passages, the pump inlet, and the pump outlet to selectively fluidly connect a heat exchanger, a pump, a thermal energy storage, and a coil fluid line.

The plurality of passages may be configured to selectively connect a heat exchanger inlet fluid line, a heat exchanger outlet fluid line, a thermal energy storage inlet fluid line, a thermal energy storage outlet fluid line, a coil inlet fluid line, a coil outlet fluid line, and a bypass fluid line with the pump inlet and the pump outlet.

The plurality of passages may extend orthogonal to an axis through the pump inlet and an axis through the pump outlet.

The plurality of passages may extend orthogonal to a rotation axis of the actuator.

An example method for controlling a refrigeration system according to the present disclosure includes: receiving, by a controller, a user input and a sensor input; determining an operating mode for a main fluid loop and a secondary fluid loop based on the user input and the sensor input, the main fluid loop including a compressor and a heat exchanger that circulate a first working fluid and the secondary fluid loop including a pump, a thermal energy storage, and a coil fluid line that circulate a second working fluid; controlling, by the controller, the main fluid loop based on the operating mode; controlling, by the controller, the secondary fluid loop based on the operating mode; and actuating, by the controller, a multi-position valve in the secondary fluid loop based on the operating mode between positions that selectively fluidly connect the heat exchanger, the pump, the thermal energy storage, and the coil fluid line.

The secondary fluid loop may be a heating secondary fluid loop, the thermal energy storage may be a hot thermal energy storage, the coil fluid line may be a heating coil fluid line, and the heat exchanger may be a condenser. The main fluid loop may include an evaporator.

The example method may include: controlling, by the controller, a cooling secondary fluid loop based on the operating mode, the cooling secondary fluid loop including a pump, a cold thermal energy storage, and a cooling coil fluid line; and actuating, by the controller, a multi-position valve in the cooling secondary fluid loop based on the operating mode between positions that selectively fluidly connect the evaporator, the pump, the cold thermal energy storage, and the cooling coil fluid line.

The example method may include: actuating, by the controller, a connection valve based on the operating mode, the connection valve selectively connecting the heating coil fluid line and the cooling coil fluid line with an indoor coil and an outdoor coil.

The first working fluid may include a low global warming potential (LGWP) refrigerant and the second working fluid includes a non-flammable refrigerant.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

Figure 1:
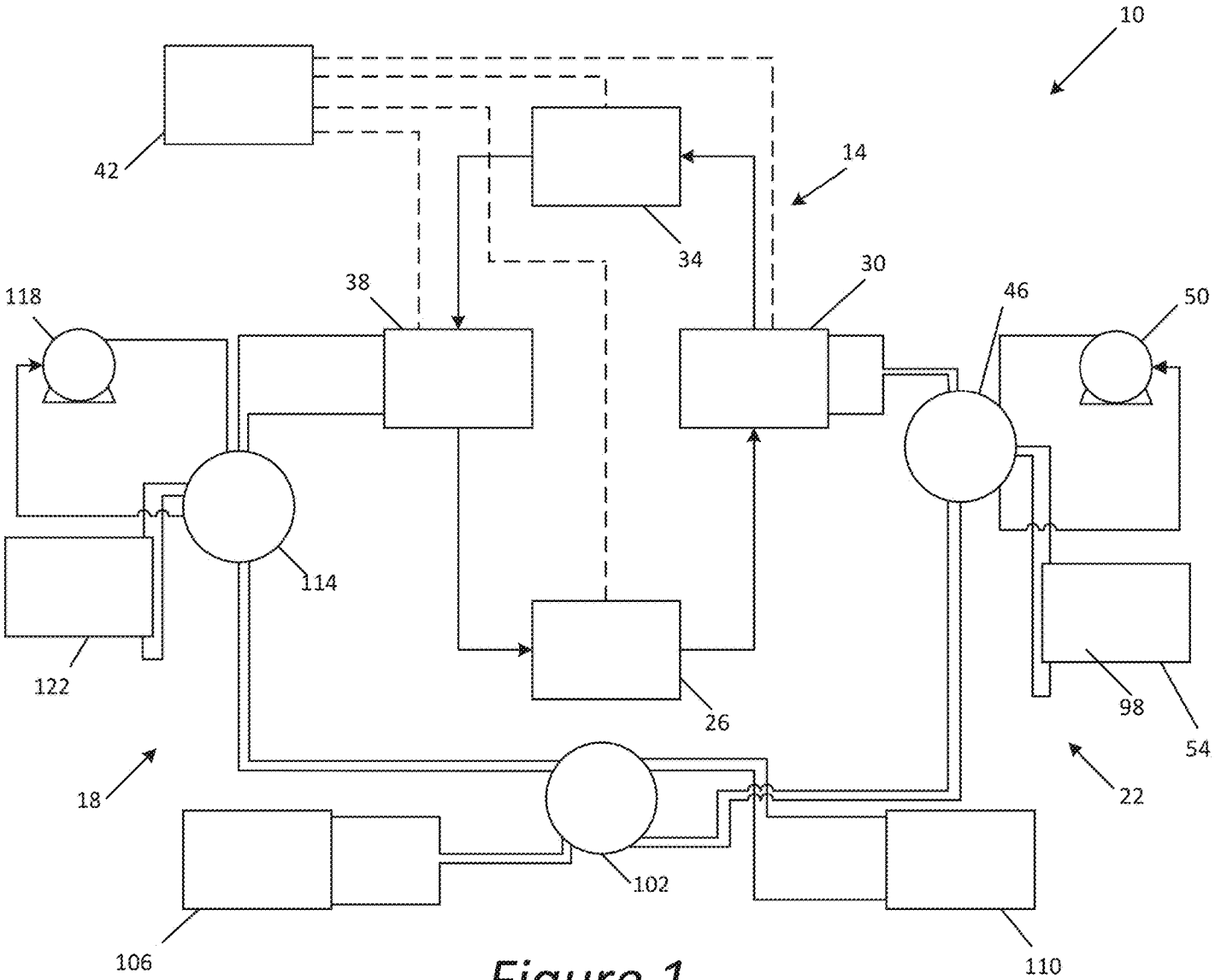
FIG. 1 is a schematic illustration of a refrigeration system according to the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In the figures, the direction of an arrow, as indicated by the arrowhead, generally demonstrates the flow of information (such as data or instructions) that is of interest to the illustration. For example, when element A and element B exchange a variety of information, but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module," the term "unit," or the term "controller" may be replaced with the term "circuit." The term "module" or the term "unit" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module or unit may include one or more interface circuits. In some examples, the interface circuits may include wired or wireless interfaces that are connected to a local area network (LAN), the Internet, a wide area network (WAN), or combinations thereof. The functionality of any given module or unit of the present disclosure may be distributed among multiple modules or units that are connected via interface circuits. For example, multiple modules or units may allow load balancing. In a further example, a server (also known as remote, or cloud) module or unit may accomplish some functionality on behalf of a client module or unit.

The term code, as used above, may include software, firmware, and/or microcode, and may refer to programs, routines, functions, classes, data structures, and/or objects. The term shared processor circuit encompasses a single processor circuit that executes some or all code from multiple modules or units. The term group processor circuit encompasses a processor circuit that, in combination with additional processor circuits, executes some or all code from one or more modules or units. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules or units. The term group memory circuit encompasses a memory circuit that, in combination with additional memories, stores some or all code from one or more modules or units.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PUP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

Proposed new refrigerants provide significant environmental benefits but common weaknesses include high temperature glide or a potential risk for thermal events or toxicity. Because of these weaknesses, the system is limited by these concerns, the refrigerant charge (i.e., the amount of refrigeration in the system) may be limited. The present disclosure addresses these issues by including a high-efficiency secondary loop system that connects to the refrigeration loop by two fixed, brazed-plate heat exchangers for the evaporator and condenser. The system described in the present disclosure allows for high-efficiency operation while using environmentally-friendly refrigerants (or fluids).

The high-efficiency secondary loop system may include a cold thermal energy storage (TES), a hot TES or a hot water heater, an indoor coil, an outdoor coil, one or more pumps, one or more multi-position valves (for example, three-position valves or four-position valves), a two-position valve, or any combination of these.

A heat exchanger may be used for thermal exchange between the main loop and the secondary loop. For example, brazed-plate heat exchangers provide high heat transfer coefficients which can reduce charge and are also recommended for high glide refrigerant applications. Brazed-plate heat exchangers provide counter-flow operation accommodating a higher temperature difference. Furthermore, the plate configuration in the brazed-plate heat exchangers improves refrigerant mixing. Alternatively, a microchannel heat exchanger may be included and may provide the same advantages. Alternatively, any other refrigerant-to-liquid heat exchanger may be included.

A thermal energy storage (TES) system which shifts cooling or heating energy use to non-peak times adds an extra advantage to the system. The TES includes a single fluid circuit for charging and discharging, allowing for a lower cost battery. Additionally, in the TES, hybrid operation (i.e. simultaneous charging and discharging) is replaced by in-series operation (i.e. simultaneous charging and comfort cooling). The system of the present disclosure achieves simultaneous charging of the TES and cooling of the space with a single fluid loop having a specially designed valve.

To provide efficiency and flexibility to the high-efficiency secondary loop system, a multi-position valve (for example, three- or four-position valve) includes a plurality of connectors for switching between various modes of the high-efficiency secondary loop system. While a two-position valve might work to switch between heating or cooling, a two-position valve implemented with the TES system requires an extra pump and low flexibility. Thus, addition of a three-position or four-position (or more-position) valve in the high-efficiency secondary loop system was found to increase the efficiency in a low-cost manner. Using the three-position or four-position valve discussed herein improves the system by eliminating the need for an extra pump. Additionally, the three-position or four-position valve provides high flexibility in the system.

In the system of the present disclosure, the three-position or four-position valve controls the flows that connect the indoor or outdoor coils to the brazed-plate heat exchanger or TES, as well as to a liquid pump. In a three-position valve, the valve controls allow for various positions providing communication between a TES and coil, an evaporator and coil, and an evaporator and TES. In a four-position valve, the valve controls allow for various positions including a discharge position, a hybrid position, a charge position, and an evaporator to coil position. An additional two-position valve controls the cooling or heating operation of the heat pump (as well as some special TES charging modes). The proposed system architecture provides significant flexibility for different operating modes, such as a traditional cooling operation (evaporator to indoor coil and condenser to outdoor coil), a TES charging cooling operation (evaporator to TES and condenser to outdoor coil), a TES discharging cooling operation (TES to indoor coil and compressor off), a TES changing operation (evaporator to TES and condenser to hot water heater), a charging hot water tank operation (evaporator to outdoor coil and condenser to hot water heater), a traditional heating operation (evaporator to outdoor coil and condenser to indoor coil), a heating and charging cold TES operation (TES to outdoor coil—cold ambient—and compressor off), a cold day heating operation (evaporator to TES and condenser to indoor coil), a hybrid cooling operation (evaporator to TES to indoor coil and condenser to TES to outdoor coil), and a hybrid heating operation (evaporator to TES to outdoor coil and condenser to TES to indoor coil).

Now referring to FIG. 1, a functional block diagram of a refrigeration system 10 is illustrated. The refrigeration system includes a main fluid loop 14, a cooling secondary fluid loop 18, and a heating secondary fluid loop 22. Each of the main fluid loop 14, the cooling secondary fluid loop 18, and the heating secondary fluid loop 22 is sealed, for example hermetically sealed or airtight, and circulates a working fluid throughout the individual loop 14, 18, 22. The main fluid loop may contain a first working fluid having a first refrigerant that is different from a refrigerant in a second working fluid in the cooling secondary fluid loop 18 and the heating secondary fluid loop 22. For example, the first refrigerant may be a low global warming potential (LGWP) refrigerant and the second refrigerant may be a non-flammable refrigerant.

The LGWP refrigerant may be a flammable refrigerant. As used herein, flammable refrigerants are refrigerants with an American Society of Heating, Refrigerating and Air-conditioning Engineers, Inc. ("ASHRAE") safety group designation, also referred to herein as a "flammability classification," of A2L, B2L, A2, B2, A3, or B3. A flammable refrigerant can be a flammable refrigerant composed of a single flammable chemical species or a mixture or blend of at least one non-flammable refrigerant with at least one flammable refrigerant, or a blend of two or more flammable refrigerants, optionally combined with one or more non-flammable refrigerants.

Flammable refrigerants may generally be gases in the methane series, ethane series, ethers, propane, organic compounds, including unsaturated organic compounds, inorganic compounds, and zeotrope mixtures. More specifically, flammable refrigerants may include: hydrocarbons, hydrochlorofluorocarbons, hydrofluorocarbons, hydrochlorocarbons, hydrofluorocarbons, and hydrofluoroolefins, by way of example. The leak detection by the principles of the present disclosure is particularly useful for flammable hydrofluorocarbon refrigerants, and/or flammable hydrofluoroolefin refrigerants or any combinations thereof.

Non-limiting examples of flammable refrigerants include the following refrigerants: saturated hydrocarbons, like methane (R50), ethane (R170), propane (R290), butane (R600), pentane (R601), 2-methylpropane (R600a), 2 methylbutane (R601a), unsaturated hydrocarbons, such as ethene (R1150), propene (R1270), or heteroatom substituted hydrocarbons, such as methoxymethane (RE170), and methyl formate (R611), hydrochlorocarbons, hydrochlorofluorocarbons, such as 1 chloro-1,1-difluoroethane (R142b), saturated hydrofluorocarbons, like difluoromethane (R32), difluoroethane (R152a), fluoroethane (R161), 1,1,1-trifluoroethane (R143a), 1,1-difluoroethane (R152a), 1,1,1-trifluoroethane (R143a), R410A (a mixture of difluoromethane (R32) and pentafluoroethane (R125)), hydrofluoroolefins (HFO) refrigerants include 3,3,3,-trifluoropropene (HFO-1234zf), HFO-1234 refrigerants like 2,3,3,3,-tetrafluoropropene (HFO-1234yf), 1,2,3,3,-tetrafluoropropene (HFO-1234ze(E)), cis- and trans-1,3,3,3,-tetrafluoropropene (HFO-1234ye(E),(Z)), pentafluoropropenes (HFO-1225) such as 1,1,3,3,3, pentafluoropropene (HFO-1225zc) or those having a hydrogen on the terminal unsaturated carbon such as 1,2,3,3,3, pentafluoropropene (HFO-1225ye(Z), fluorochloropropenes such as trifluoro, monochloropropenes (HFO-1233) like CF3CCl═CH2 (HFO-1233xf) and CF3CH═CHCl (HFO-1233zd), hydrogen (R702), ammonia (R717), azeotropes, such as, for example, R403A, R406A, R411A, R411B, R412A, R413A, R415A, R415B, R418A, R419A, R419B, R429A, R430A, R431A, R432A, R433A, R433B, R433C, R435A, R436A, R436B, R439A, R440A, R441a, R443A, R444A, R444B, R445A, R446A, R447A, R448A, R449A, R450A, R451A, R451B, R452A, R510A, R511A, R512A, R513A, and combinations thereof. For example, certain flammable refrigerants may include a hydrofluoroolefin (HFO) Blend 1 (a mixture of difluoromethane (R32), 1,2,3,3,-tetrafluoropropene (HFO-1234ze(E)), 3,3,3,-trifluoropropene (HFO-1234zf), and difluoroethane (R152a)) or a hydrofluoroolefin (HFO) Blend 2 (a mixture of difluoromethane (R32), trans 1-chloro-3,3,3-trifluoropropene, HFO-1233zd(E), and 3,3,3,-trifluoropropene (HFO 1234zf)). In certain variations, the flammable refrigerant is selected from difluoromethane (R32).

Flammable refrigerants, such as at least some LGWP refrigerants, pose greater risks than non-flammable refrigerants, especially in confined spaces and indoor applications. Thus, it is desirable to split the fluid loop into sections to isolate the fluid loop containing the LGWP refrigerant in a location external to homes and businesses for safety. Accordingly, the main fluid loop 14 of system 10 may be disposed external to a home or business, while the cooling secondary fluid loop 18 and the heating secondary fluid loop 22 may be located within the home or business. This arrangement increases the safety of the occupants within the home or business.

Alternatively, the main fluid loop 14 may contain a working fluid having a first refrigerant that is the same as a second refrigerant in the working fluid of the cooling secondary fluid loop 18 and the heating secondary fluid loop 22. For example, the first refrigerant and the second refrigerant may both be non-flammable refrigerants.

In certain variations, exemplary non-flammable refrigerants include those selected from the group consisting of: saturated or unsaturated fluorocarbons, chlorofluorocarbons, hydrochlorofluorocarbons, fluoroethers, hydrocarbons, carbon dioxide, ammonia, dimethyl ether, and combinations thereof. For example, the non-flammable refrigerant may be water, a water-glycol mixture, or another fluid.

The main fluid loop 14 includes a compressor 26, a heat exchanger such as a condenser 30, an expansion valve 34, and a heat exchanger such as an evaporator 38. The compressor 26 receives the working fluid in vapor form and compresses the working fluid, providing pressurized working fluid in vapor form to the condenser 30. The compressor 26 includes an electric motor and may be a scroll compressor, a reciprocating compressor, a screw compressor, a rotary compressor, or any other suitable compressor.

All or a portion of the pressurized working fluid is converted into liquid form within the condenser 30. The condenser 30 transfers heat away from the working fluid, thereby cooling the working fluid. When the refrigerant vapor is cooled to a temperature that is less than a saturation temperature, the working fluid transforms into a liquid (or liquefied) working fluid.

The condenser 30 may be a brazed-plate heat exchanger. The brazed-plate heat exchanger is used to transfer heat from one fluid to another through thin metal plates. The brazed-plate heat exchanger includes thin metal heat transfer plates that are stacked in superposed relation and sealed by brazing, providing the heat exchanger with a high heat transfer coefficient. For example, copper or nickel may be used as the brazing metal. Brazing metallugically bonds the thin heat transfer plates at contact points throughout the plate stack. The multiple bonds cause the heat exchanger to be rigid. Additionally, the plate stack can withstand internal pressure without the use of any covers.

The plate stack includes ports and passages for the flow of the working fluid. The plate configuration improves refrigerant mixing in the working fluid. Hot working fluid from the main fluid loop 14 flows through a first side of the condenser 30 and working fluid from the heating secondary fluid loop 22 flows through a second, opposite side of the condenser 30. The working fluid from the main fluid loop 14 flows in a direction opposite a flow direction of the working fluid from the heating secondary fluid loop 22. The counter-flow operation accommodates a high temperature difference and enables the working fluid from the main fluid loop 14 to heat the working fluid in the heating secondary fluid loop 22.

While the condenser 30 is described as a brazed-plate heat exchanger, the disclosure is not limited to this single example. The condenser 30 may be any suitable heat exchanger that transfers heat from one fluid to another.

The condenser 30 provides the working fluid to the evaporator 38 via the expansion valve 34. The expansion valve 34 controls the flow rate at which the working fluid is supplied to the evaporator 38. The expansion valve 34 may include a thermostatic expansion valve or may be controlled electronically by, for example, a system controller 42. A pressure drop caused by the expansion valve 34 may cause a portion of the liquefied working fluid to transform back into the vapor form. In this manner, the evaporator 38 may receive a mixture of working fluid vapor and liquefied working fluid.

The working fluid of the main fluid loop 14 absorbs heat in the evaporator 38. Liquid working fluid transitions into vapor form when warmed to a temperature that is greater than the saturation temperature of the working fluid.

The evaporator 38 may be a brazed-plate heat exchanger. The brazed-plate heat exchanger is used to transfer heat from one fluid to another through thin metal plates. The brazed-plate heat exchanger includes thin metal heat transfer plates that are stacked in superposed relation and sealed by brazing, providing the heat exchanger with a high heat transfer coefficient. For example, copper or nickel may be used as the brazing metal. Brazing metallugically bonds the thin heat transfer plates at contact points throughout the plate stack. The multiple bonds cause the heat exchanger to be rigid. Additionally, the plate stack can withstand internal pressure without the use of any covers.

The plate stack includes ports and passages for the flow of the working fluid. The plate configuration improves refrigerant mixing in the working fluid. Working fluid from the main fluid loop 14 flows through a first side of the evaporator 38 and working fluid from the cooling secondary fluid loop 18 flows through a second, opposite side of the evaporator 38. The working fluid from the main fluid loop 14 flows in a direction opposite a flow direction of the working fluid from the cooling secondary fluid loop 18. The counter-flow operation accommodates a high temperature difference and enables the working fluid from the main fluid loop 14 to absorb the heat from the working fluid in the cooling secondary fluid loop 18.

While the evaporator 38 is described as a brazed-plate heat exchanger, the disclosure is not limited to this single example. The evaporator 38 may be any suitable heat exchanger that transfers heat from one fluid to another.

The system controller 42 controls the refrigeration system. For example only, the system controller 42 may control the refrigeration system based on user inputs and/or parameters measured by various sensors (not shown). The sensors may include pressure sensors, temperature sensors, current sensors, voltage sensors, etc.

The main fluid loop 14 transmits cooling and heating to the cooling secondary fluid loop 18 and the heating secondary fluid loop 22, respectively. For example, the main fluid loop 14 may transfer heat from the working fluid to the working fluid of the heating secondary fluid loop 22 through the condenser 30. The brazed-plate heat exchanger structure of the condenser 30 allows heat to be transferred from the working fluid of the main fluid loop 14 to the working fluid of the heating secondary fluid loop 22 while keeping the working fluids separate.

As previously explained, the working fluid of the heating secondary fluid loop 22 may be different from the working fluid of the main fluid loop 14. For example, the working fluid of the heating secondary fluid loop 22 may include a second refrigerant different from a first refrigerant of the working fluid in the main fluid loop 14. For example, the second refrigerant may be a non-flammable refrigerant. In certain variations, exemplary non-flammable refrigerants include those selected from the group consisting of: saturated or unsaturated fluorocarbons, chlorofluorocarbons, hydrochlorofluorocarbons, fluoroethers, hydrocarbons, carbon dioxide, ammonia, dimethyl ether, and combinations thereof. For example, the second refrigerant may be water, a water-glycol mixture, or another fluid.

Alternatively, the working fluid of the heating secondary fluid loop 22 may be the same as the working fluid of the main fluid loop 14.

The heating secondary fluid loop 22 includes a multi-position valve 46, a pump 50, and a hot thermal energy storage (TES) 54 (or a hot water tank, for example). The multi-position valve 46 may be a three-position, four-position, or more-position valve. The multi-position valve 46 may control the flow that connects an indoor coil or outdoor coil (described below) to the condenser 30, the hot TES 54, and the pump 50.

Figure 2:
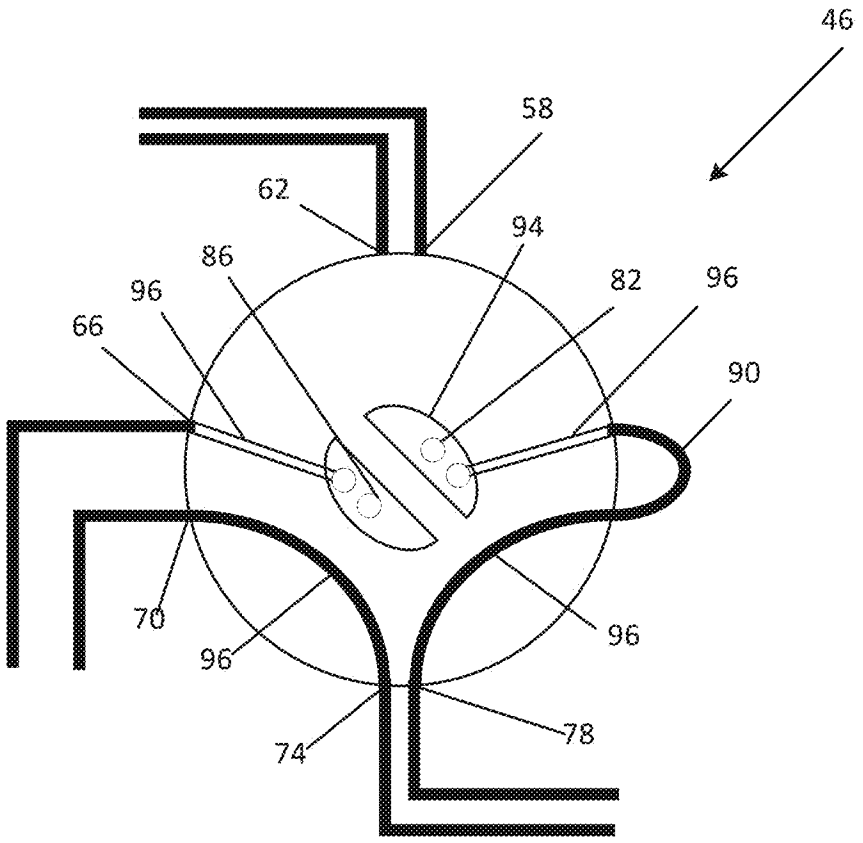
FIG. 2 is a schematic illustration of a multi-position valve of the refrigeration system in FIG. 1.
Figure 3:
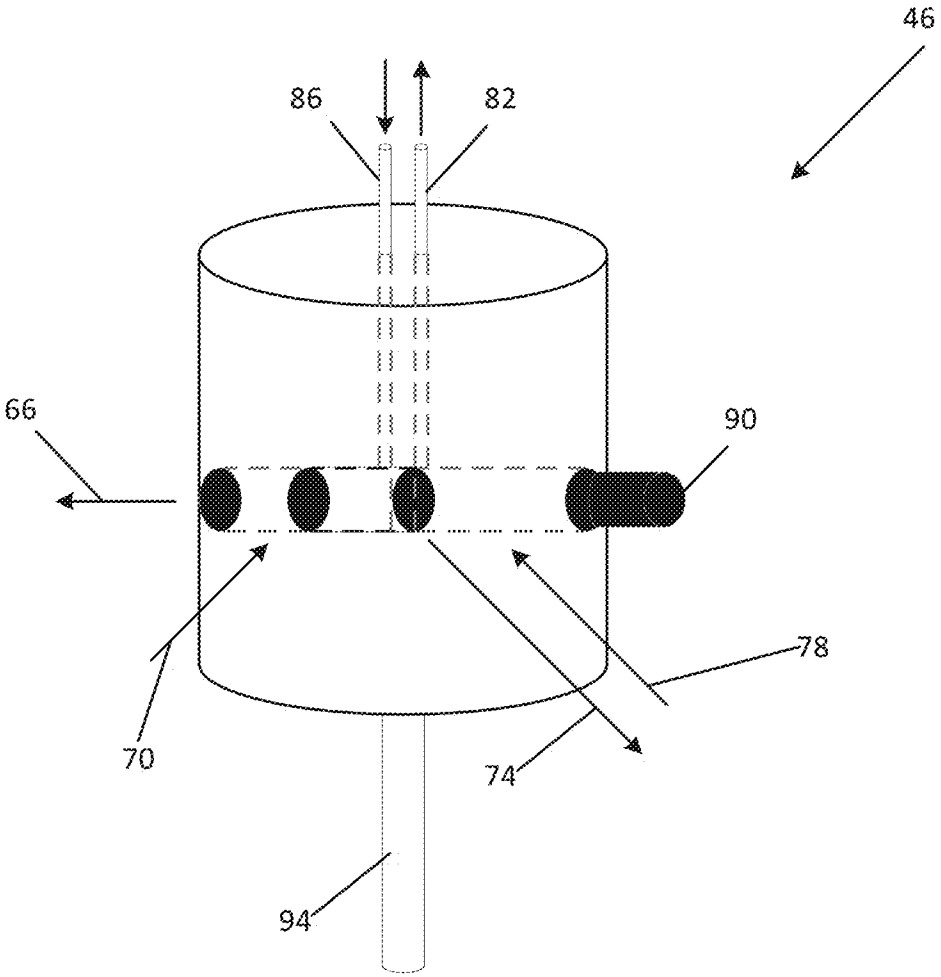
FIG. 3 is another schematic illustration of the multi-position valve in FIG. 2.

Referring to FIGS. 2 and 3, the multi-position valve 46 may connect a condenser inlet fluid line 58, a condenser outlet fluid line 62, a hot TES inlet fluid line 66, a hot TES outlet fluid line 70, a coil inlet fluid line 74, a coil outlet fluid line 78, a pump inlet fluid line 82, a pump outlet fluid line 86, and a bypass fluid line 90. The multi-position valve 46 may include an actuator 94 that rotates a position of passages 96 within the multi-position valve 46 to connect various inlets and outlets for fluid lines. For example, the actuator 94 may move the passages 96 between four positions (for a four-position valve).

Figure 4B:
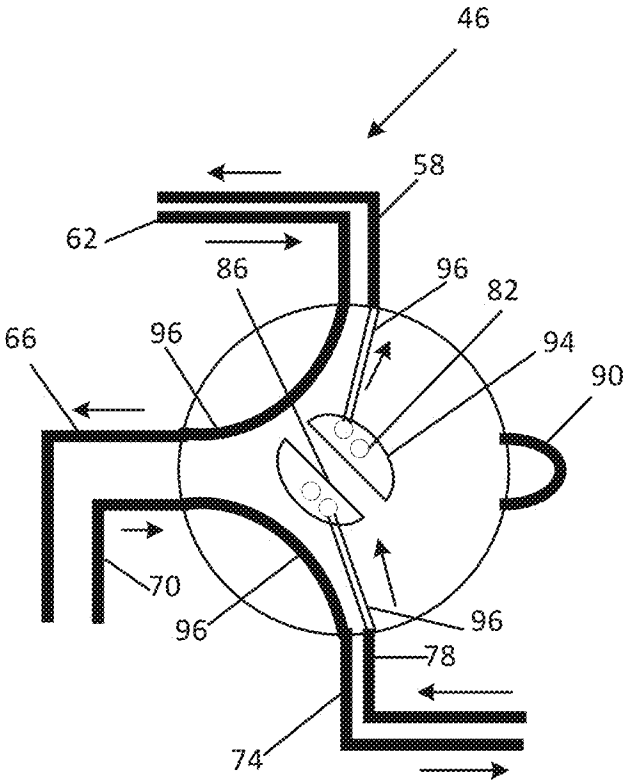
FIG. 4B is a schematic illustration of the multi-position valve in FIG. 2 in another configuration.
Figure 4A:
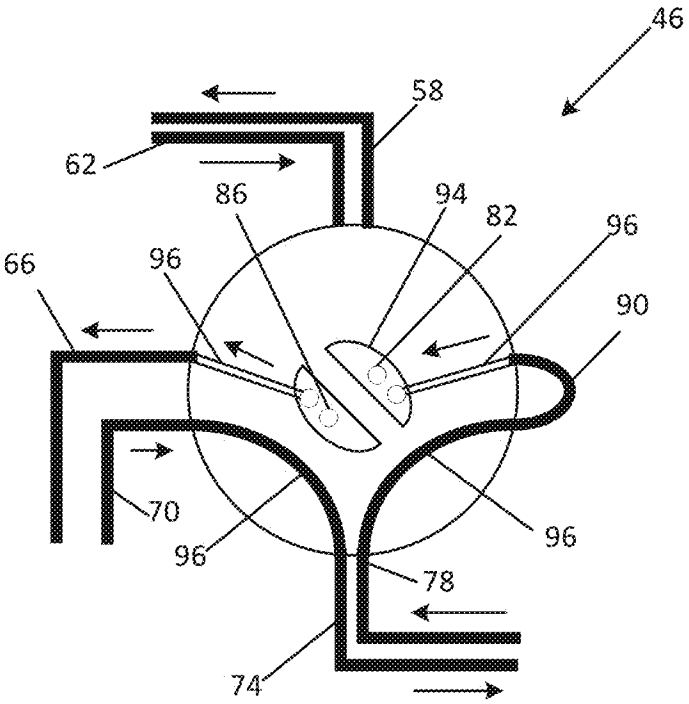
FIG. 4A is a schematic illustration of the multi-position valve in FIG. 2 in a first configuration.

Referring to FIGS. 4A-4D, the four multi-position valve 46 positions are illustrated. As shown in FIG. 4A, the multi-position valve 46 is in a first position or a discharge position. The actuator 94 is positioned such that the coil outlet fluid line 78 is connected to the pump inlet fluid line 82 through the bypass fluid line 90. The pump outlet fluid line 86 is connected to the hot TES inlet fluid line 66, and the hot TES outlet fluid line 70 is connected to the coil inlet fluid line 74. The condenser inlet fluid line 58 and the condenser outlet fluid line 62 are disconnected from the remainder of the system. The multi-position valve 46, therefore, connects the appropriate fluid lines such that the coil (i.e., either the indoor coil or the outdoor coil) may be heated by pumping working fluid from the hot TES 54 to the coil (i.e., either the indoor coil or the outdoor coil) and by pumping the working fluid from the coil back through the pump 50. The hot TES 54 is discharged and the coil (i.e., either the indoor coil or the outdoor coil) is heated.

As shown in FIG. 4B, the multi-position valve 46 is in a second position or a hybrid position. The actuator 94 is positioned such that the condenser outlet fluid line 62 is connected to the hot TES inlet fluid line 66, the hot TES outlet fluid line is connected to the coil inlet fluid line 74. The coil outlet fluid line 78 is connected to the pump inlet fluid line 82, and the pump outlet fluid line 86 is connected to the condenser inlet fluid line 58. The bypass fluid line 90 is disconnected from the remainder of the system. The multi-position valve 46, accordingly, connects the appropriate fluid lines such that the coil (i.e., either the indoor coil or the outdoor coil) may be heated by pumping working fluid from the hot TES 54 to the coil (i.e., either the indoor coil or the outdoor coil) and by pumping the working fluid from the coil back through the pump 50. The hot TES 54 is heated by pumping the working fluid from the condenser 30. Thus, in this hybrid position, the condenser 30 heats the hot TES 54 and the hot TES 54 heats the coil (i.e., either the indoor coil or the outdoor coil).

Figure 4D:
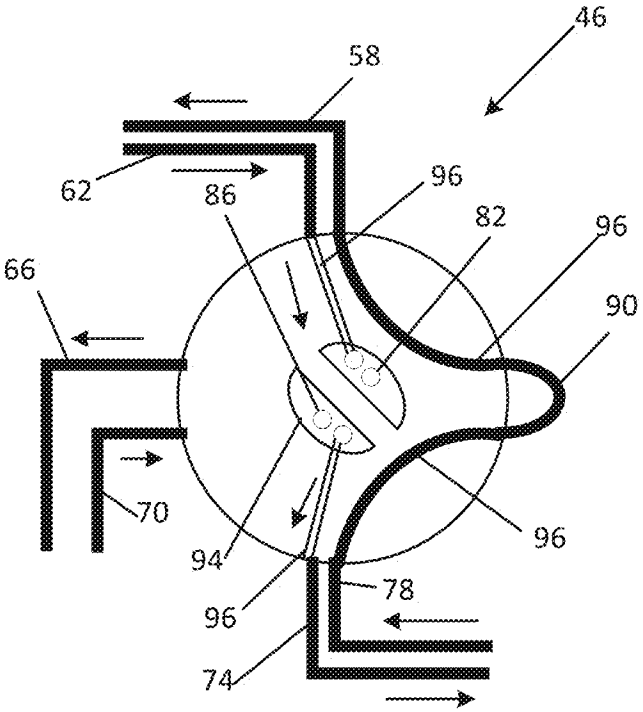
FIG. 4D is a schematic illustration of the multi-position valve in FIG. 2 in another configuration.
Figure 4C:
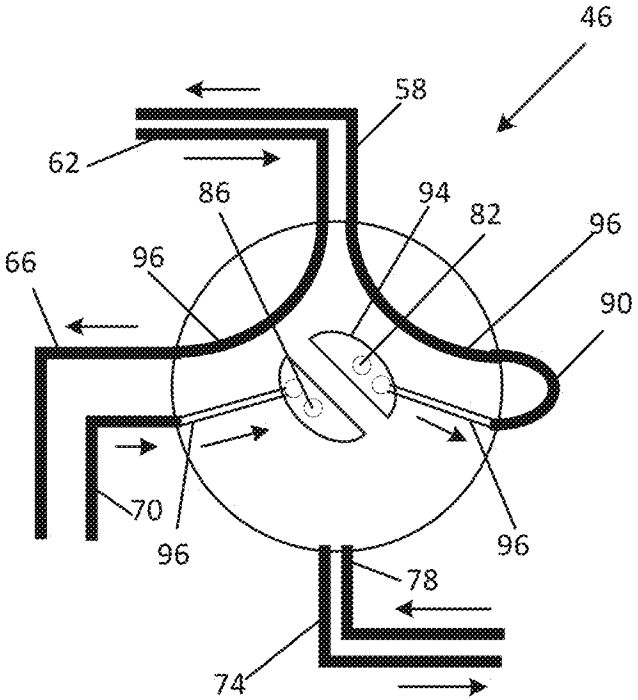
FIG. 4C is a schematic illustration of the multi-position valve in FIG. 2 in another configuration.

As shown in FIG. 4C, the multi-position valve 46 is in a third position or a charge position. The actuator 94 is positioned such that the condenser outlet fluid line 62 is connected to the hot TES inlet fluid line 66. The hot TES outlet fluid line 70 is connected to the pump inlet fluid line 82, and the pump outlet fluid line 86 is connected to the condenser inlet fluid line 58 through the bypass fluid line 90. The coil inlet fluid line 74 and the coil outlet fluid line 78 are disconnected from the remainder of the system. The multi-position valve 46, therefore, connects the appropriate fluid lines such that the hot TES 54 may be heated, and thus charged, by the condenser 30.

As shown in FIG. 4D, the multi-position valve 46 is in a fourth position or a condenser-to-coil position. The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system. The multi-position valve 46, therefore, connects the appropriate fluid lines such that the condenser 30 is connected to, and heats, the coil (i.e., either indoor coil or outdoor coil).

The pump 50 is configured to pump the working fluid of the heating secondary fluid loop 22 between the condenser 30, the multi-position valve 46, the hot TES 54, and the coil inlet fluid line 74 and coil outlet fluid line 78 (i.e., either the indoor coil or the outdoor coil). For example, the pump 50 may be a radial pump, a gear pump, a screw pump, a vane pump, a piston pump, or any other suitable liquid pump.

The hot TES 54 is a thermal energy storage system which shifts heating energy use to non-peak times and adds an extra advantage to the refrigeration system 10. The hot TES 54 includes a single fluid circuit for charging and discharging, allowing for a lower cost battery. The hot TES 54 may include a tank 98. The working fluid enters the hot TES 54 through the hot TES inlet fluid line 66. For example, the working fluid may enter the hot TES 54 near a top of the tank 98. The tank 98 may hold the working fluid until it is ready for use. The working fluid may exit the hot TES 54 through the hot TES outlet fluid line 70. For example, the working fluid may exit the hot TES 54 near a bottom of the tank 98. Alternatively, the working fluid may enter the hot TES 54 near a bottom of the tank 98 and may exit near a top of the tank 98. Alternatively, the working fluid may enter and exit the hot TES 54 at any location on the tank 98.

Alternatively, the hot TES 54 may be a hot water storage tank, ionic fluid, a paraffin wax or any other suitable fluid or material.

The coil inlet fluid line 74 and coil outlet fluid line 78 direct the working fluid from the heating secondary fluid loop 22 to and from a valve 102 that selectively connects the coil inlet fluid line 74 and coil outlet fluid line 78 with an indoor coil 106 and an outdoor coil 110, as described below (See FIG. 1).

Referring back to FIG. 1, the main fluid loop 14 transmits cooling to the cooling secondary fluid loop 18. For example, the cooling secondary fluid loop 18 may transfer heat from the working fluid to the working fluid of the main fluid loop 14 through the evaporator 38. The brazed-plate heat exchanger structure of the evaporator 38 allows heat to be transferred from the working fluid of the cooling secondary fluid loop 18 to the working fluid of the main fluid loop 14 while keeping the working fluids separate.

As previously explained, the working fluid of the cooling secondary fluid loop 18 may be different from the working fluid of the main fluid loop 14. The working fluid of the cooling secondary fluid loop 18 may be the same as, or similar to, the working fluid of the heating secondary fluid loop 22. For example, the working fluid of the cooling secondary fluid loop 18 may include a second refrigerant different from a first refrigerant of the working fluid in the main fluid loop 14. For example, the second refrigerant may be a non-flammable refrigerant. In certain variations, exemplary non-flammable refrigerants include those selected from the group consisting of: saturated or unsaturated fluorocarbons, chlorofluorocarbons, hydrochlorofluorocarbons, fluoroethers, hydrocarbons, carbon dioxide, ammonia, dimethyl ether, and combinations thereof. For example, the second refrigerant may be water, a water-glycol mixture, or another fluid.

Alternatively, the working fluid of the cooling secondary fluid loop 18 may be the same as the working fluid of the main fluid loop 14.

The cooling secondary fluid loop 18 includes a multi-position valve 114, a pump 118, and a cold thermal energy storage (TES) 122. The multi-position valve 114 may be a three-position, four-position, or more-position valve. The multi-position valve 114 may control the flow that connects the indoor coil 106 or outdoor coil 110 to the evaporator 38, the cold TES 122, and/or the pump 118.

Referring to FIGS. 5A-5D, the multi-position valve 114 may be the same as, or similar to, the multi-position valve 46, except that the multi-position valve 114 may connect an evaporator inlet fluid line 126, an evaporator outlet fluid line 130, a cold TES inlet fluid line 134, a cold TES outlet fluid line 138, a coil inlet fluid line 142, a coil outlet fluid line 146, a pump inlet fluid line 150, a pump outlet fluid line 154, and a bypass fluid line 158. The multi-position valve 114 may include an actuator 162 that rotates a position of passages 166 within the multi-position valve 114 to connect various inlets and outlets for fluid lines. For example, the actuator 162 may move the passages 166 between four positions (for a four-position valve).

Figure 5B:
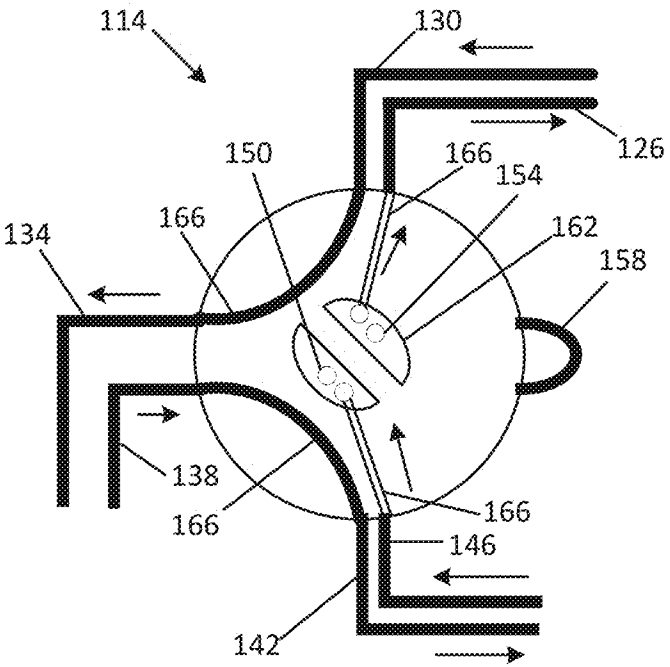
FIG. 5B is a schematic illustration of the multi-position valve in FIG. 5A in another configuration.
Figure 5A:
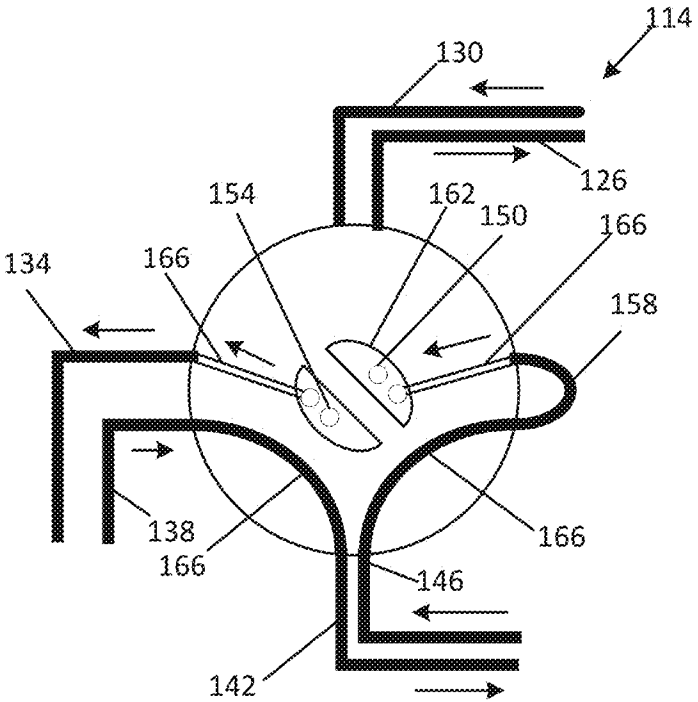
FIG. 5A is a schematic illustration of another multi-position valve of the refrigeration system in FIG. 1.

Referring to FIGS. 5A-5D, the four multi-position valve 114 positions are illustrated. As shown in FIG. 5A, the multi-position valve 114 is in a first position or a discharge position. The actuator 162 is positioned such that the coil outlet fluid line 146 is connected to the pump inlet fluid line 150 through the bypass fluid line 158. The pump outlet fluid line 154 is connected to the cold TES inlet fluid line 134, and the cold TES outlet fluid line 138 is connected to the coil inlet fluid line 142. The evaporator inlet fluid line 126 and the evaporator outlet fluid line 130 are disconnected from the remainder of the system. The multi-position valve 114, therefore, connects the appropriate fluid lines such that the coil (i.e., either the indoor coil 106 or the outdoor coil 110) may be cooled by pumping working fluid from the cold TES 122 to the coil (i.e., either the indoor coil 106 or the outdoor coil 110) and by pumping the working fluid from the coil back through the pump 118. The cold TES 122 is discharged and the coil (i.e., either the indoor coil 106 or the outdoor coil 110) is cooled.

As shown in FIG. 5B, the multi-position valve 114 is in a second position or a hybrid position. The actuator 162 is positioned such that the evaporator outlet fluid line 130 is connected to the cold TES inlet fluid line 134, the cold TES outlet fluid line 138 is connected to the coil inlet fluid line 142. The coil outlet fluid line 146 is connected to the pump inlet fluid line 150, and the pump outlet fluid line 154 is connected to the evaporator inlet fluid line 126. The bypass fluid line 158 is disconnected from the remainder of the system. The multi-position valve 114, accordingly, connects the appropriate fluid lines such that the coil (i.e., either the indoor coil 106 or the outdoor coil 110) may be cooled by pumping working fluid from the cold TES 122 to the coil (i.e., either the indoor coil 106 or the outdoor coil 110) and by pumping the working fluid from the coil 106, 110 back through the pump 118. The cold TES 122 is cooled by pumping the working fluid from the evaporator 38. Thus, in this hybrid position, the evaporator 38 cools the cold TES 122 and the cold TES 122 cools the coil (i.e., either the indoor coil 106 or the outdoor coil 110).

Figure 5D:
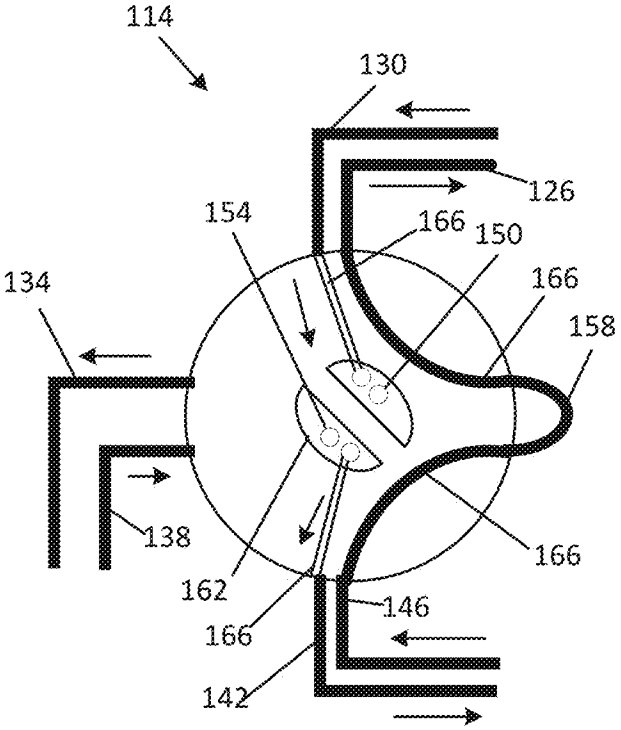
FIG. 5D is a schematic illustration of the multi-position valve in FIG. 5A in another configuration.
Figure 5C:
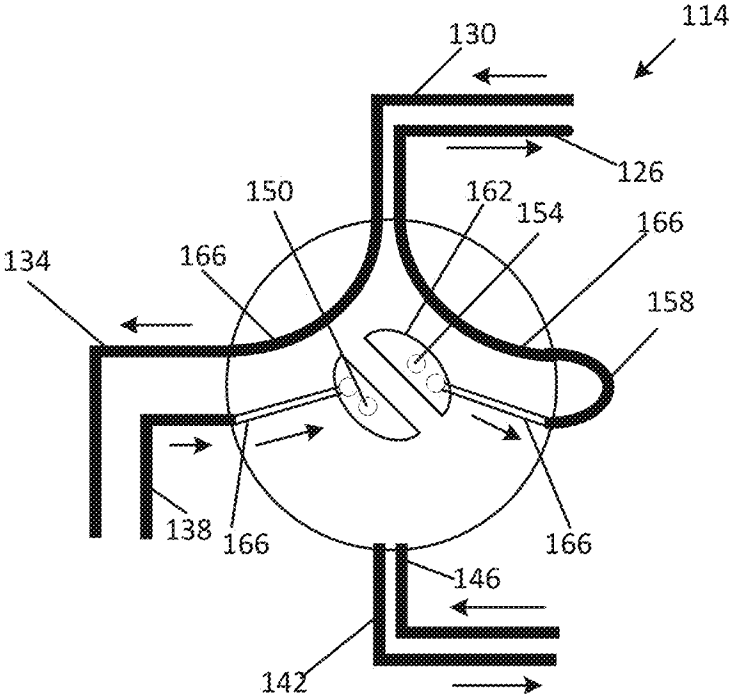
FIG. 5C is a schematic illustration of the multi-position valve in FIG. 5A in another configuration.

As shown in FIG. 5C, the multi-position valve 114 is in a third position or a charge position. The actuator 162 is positioned such that the evaporator outlet fluid line 130 is connected to the cold TES inlet fluid line 134. The cold TES outlet fluid line 138 is connected to the pump inlet fluid line 150, and the pump outlet fluid line 154 is connected to the evaporator inlet fluid line 126 through the bypass fluid line 158. The coil inlet fluid line 142 and the coil outlet fluid line 146 are disconnected from the remainder of the system. The multi-position valve 114, therefore, connects the appropriate fluid lines such that the cold TES 122 may be cooled, and thus charged, by the evaporator 38.

As shown in FIG. 5D, the multi-position valve 114 is in a fourth position or an evaporator-to-coil position. The actuator 162 is positioned such that the evaporator outlet fluid line 130 is connected to the pump inlet fluid line 150. The pump outlet fluid line 154 is connected to the coil inlet fluid line 142, and the coil outlet fluid line 146 is connected to the evaporator inlet fluid line 126 through the bypass fluid line 158. The cold TES inlet fluid line 134 and the cold TES outlet fluid line 138 are disconnected from the remainder of the system. The multi-position valve 114, therefore, connects the appropriate fluid lines such that the evaporator 38 is connected to, and cools, the coil (i.e., either the indoor coil 106 or the outdoor coil 110).

The pump 118 is configured to pump the working fluid of the cooling secondary fluid loop 18 between the evaporator 38, the multi-position valve 114, the cold TES 122, and the coil inlet fluid line 142 and coil outlet fluid line 146 (i.e., either the indoor coil 106 or the outdoor coil 110). For example, the pump 118 may be a radial pump, a gear pump, a screw pump, a vane pump, a piston pump, or any other suitable liquid pump.

The cold TES 122 is a thermal energy storage system which shifts cooling energy use to non-peak times and adds an extra advantage to the refrigeration system 10. The cold TES 122 includes a single fluid circuit for charging and discharging, allowing for a lower cost battery. The cold TES 122 may include a tank 170. The working fluid enters the cold TES 122 through the cold TES inlet fluid line 134. For example, the working fluid may enter the cold TES 122 near a top of the tank 170. The tank 170 may hold the working fluid until it is ready for use. The working fluid may exit the cold TES 122 through the cold TES outlet fluid line 138. For example, the working fluid may exit the cold TES 122 near a bottom of the tank 170. Alternatively, the working fluid may enter the cold TES 122 near a bottom of the tank 170 and may exit near a top of the tank 170. Alternatively, the working fluid may enter and exit the cold TES 122 at any location on the tank 170.

For example, the cold TES 122 may be a cold water TES or may be ice. Alternatively, the cold TES 122 may be a phase-change paraffin with a phase change temperature above the freezing point of water.

The coil inlet fluid line 142 and coil outlet fluid line 146 direct the working fluid from the cooling secondary fluid loop 18 to and from the valve 102 that selectively connects the coil inlet fluid line 142 and coil outlet fluid line 146 with the indoor coil 106 and the outdoor coil 110.

Figure 6A:
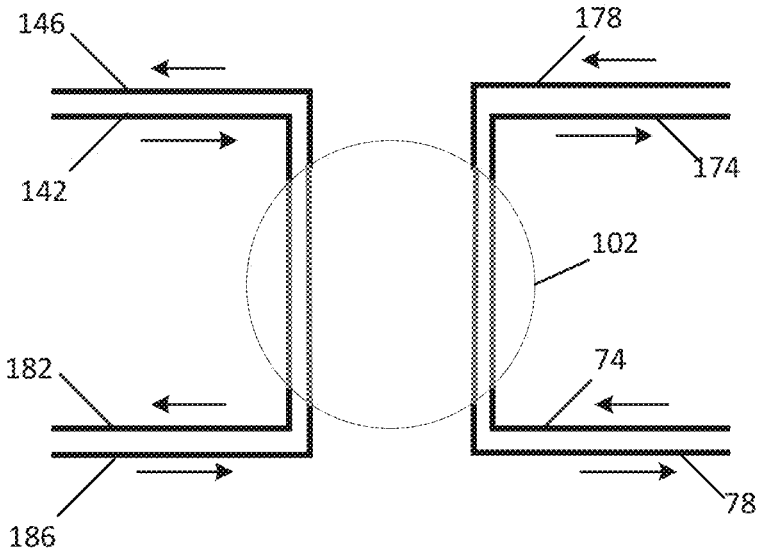
FIG. 6A is a schematic illustration of a valve of the refrigeration system in FIG. 1.
Figure 6B:
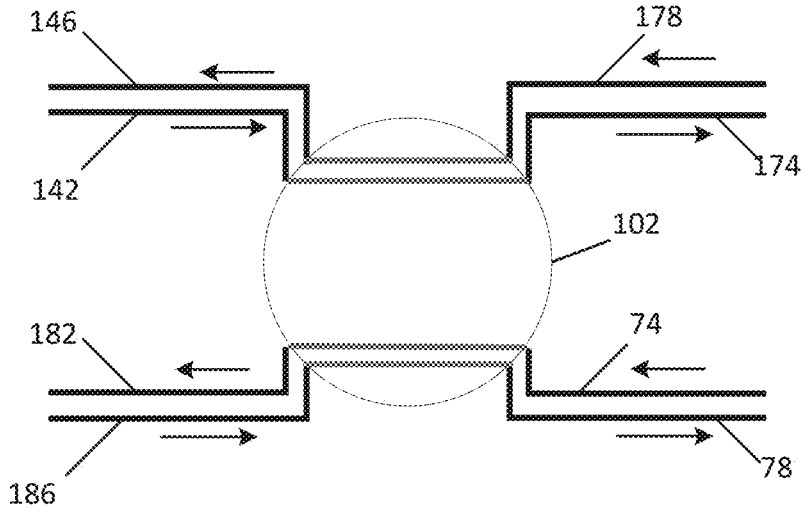
FIG. 6B is a schematic illustration of the valve in FIG. 6A in another configuration.

With additional reference to FIGS. 6A and 6B, the valve 102 may be a two-way or two-position valve. The valve 102 may control the cooling or heating operation of the refrigeration system 10. The valve may move, or rotate, between a first position and a second position. In the first position, the valve 102 may connect the coil inlet fluid line 74 and coil outlet fluid line 78 from the heating secondary fluid loop 22 with an outdoor coil inlet fluid line 174 and an outdoor coil outlet fluid line 178 of the outdoor coil 110, respectively, as illustrated in FIG. 6A. In the first position, the valve 102 may also connect the coil inlet fluid line 142 and the coil outlet fluid line 146 of the cooling secondary fluid loop 18 with an indoor coil inlet fluid line 182 and an indoor coil outlet fluid line 186 of the indoor coil 106, respectively.

In the second position, the valve 102 may connect the coil inlet fluid line 74 and coil outlet fluid line 78 from the heating secondary fluid loop 22 with the indoor coil inlet fluid line 182 and the indoor coil outlet fluid line 186 of the indoor coil 106, respectively, as illustrated in FIG. 6B. In the second position, the valve 102 may also connect the coil inlet fluid line 142 and the coil outlet fluid line 146 of the cooling secondary fluid loop 18 with the outdoor coil inlet fluid line 174 and the outdoor coil outlet fluid line 178 of the outdoor coil 110, respectively.

Through use of the multi-position valves 46 and 114 and the valve 102, the refrigeration system 10 is able to achieve at least ten (for example, up to twenty) operating modes for efficient, optimal heating and cooling. Additionally, the ten operating modes only require one compressor, one evaporator, one expansion valve, one condenser, two multi-position valves, two pumps, one hot TES, one cold TES, one two-position valve, one indoor coil, and one outdoor coil. Efficiency and added flexibility is, therefore, achieved to provide a system with flexibility and load-shifting capabilities all year round. The system can be efficient, or it can cool a room quickly—all at the user's discretion. Additionally, the multi-position valve provides a system with flexibility having a low number of parts compared to systems with similar flexibility.

Figure 7:
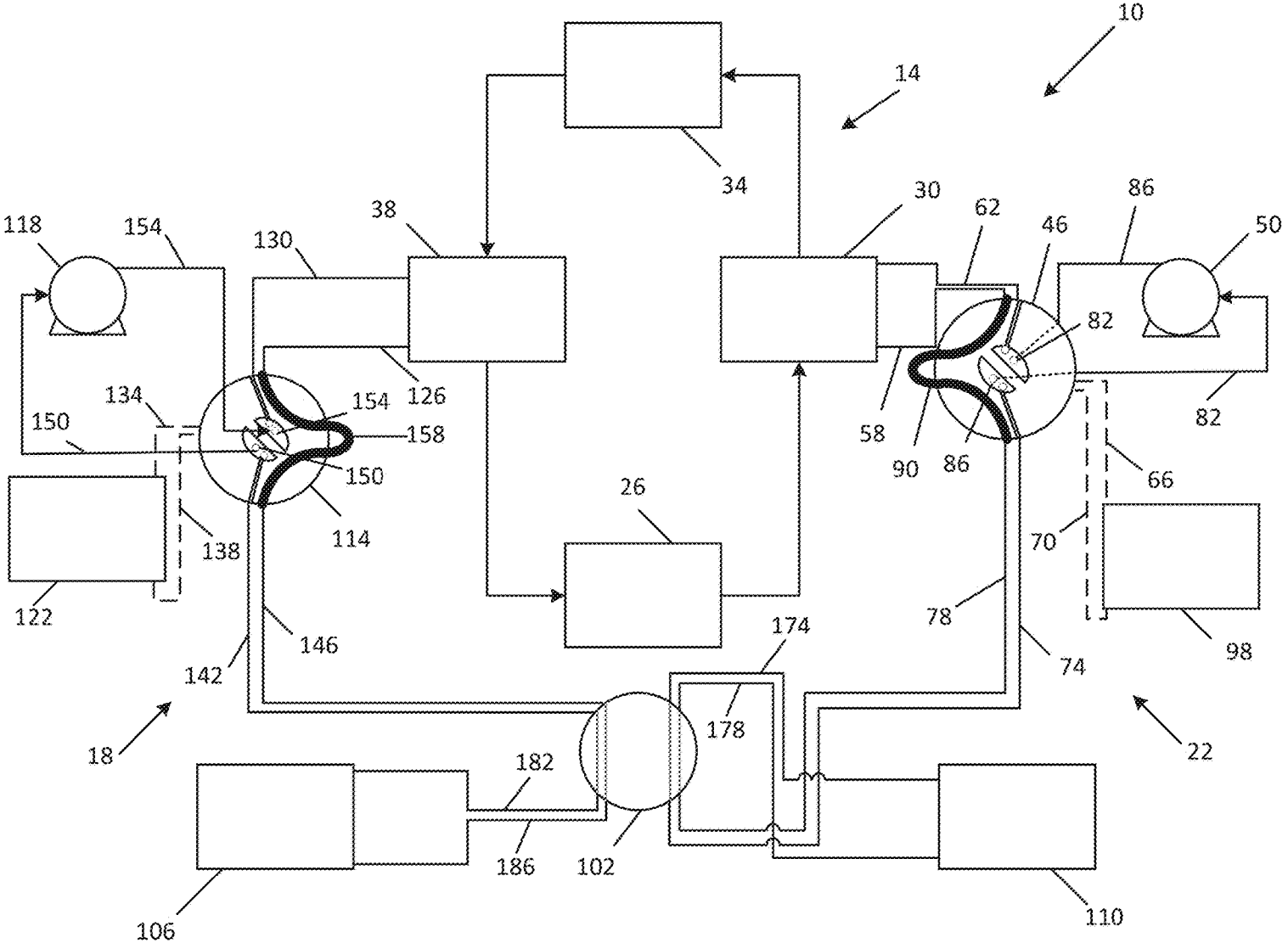
FIG. 7 is a schematic illustration of the refrigeration system in FIG. 1 in an operation mode configuration.

Referring to FIG. 7, the refrigeration system 10 may be configured in a cooling traditional operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the indoor coil 106 and the condenser 30 may be in communication with the outdoor coil 110. For example, the refrigeration system 10 may be configured such that the cooling secondary fluid loop 18 is in communication with the indoor coil 106 and the heating secondary fluid loop 22 is in communication with the outdoor coil 110. The valve 102 may be in the first position (FIG. 6A) where the valve 102 connects the coil inlet fluid line 142 and the coil outlet fluid line 146 of the cooling secondary fluid loop 18 with the indoor coil inlet fluid line 182 and the indoor coil outlet fluid line 186 of the indoor coil 106, respectively. The valve 102 connects the coil inlet fluid line 74 and coil outlet fluid line 78 from the heating secondary fluid loop 22 with the outdoor coil inlet fluid line 174 and the outdoor coil outlet fluid line 178 of the outdoor coil 110, respectively.

The multi-position valve 46 may be positioned in the condenser-to-coil position (FIG. 4D). The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system. The multi-position valve 46, therefore, connects the appropriate fluid lines such that the condenser 30 is connected to, and heats, the outdoor coil 110.

The multi-position valve 114 may be positioned in the evaporator-to-coil position (FIG. 5D). The actuator 162 is positioned such that the evaporator outlet fluid line 130 is connected to the pump inlet fluid line 150. The pump outlet fluid line 154 is connected to the coil inlet fluid line 142, and the coil outlet fluid line 146 is connected to the evaporator inlet fluid line 126 through the bypass fluid line 158. The cold TES inlet fluid line 134 and the cold TES outlet fluid line 138 are disconnected from the remainder of the system. The multi-position valve 114, therefore, connects the appropriate fluid lines such that the evaporator 38 is connected to, and cools, the indoor coil 106.

Accordingly, the multi-position valves 46 and 114 and the valve 102 connect the condenser 30 to the outdoor coil 110 through the pump 50 and connect the evaporator 38 to the indoor coil 106 through the pump 118. Thus, heat from the heating secondary fluid loop 22 is discharged through the outdoor coil 110 and the interior space is cooled through cooling provided from the cooling secondary fluid loop 18 through the indoor coil 106.

Figure 8:
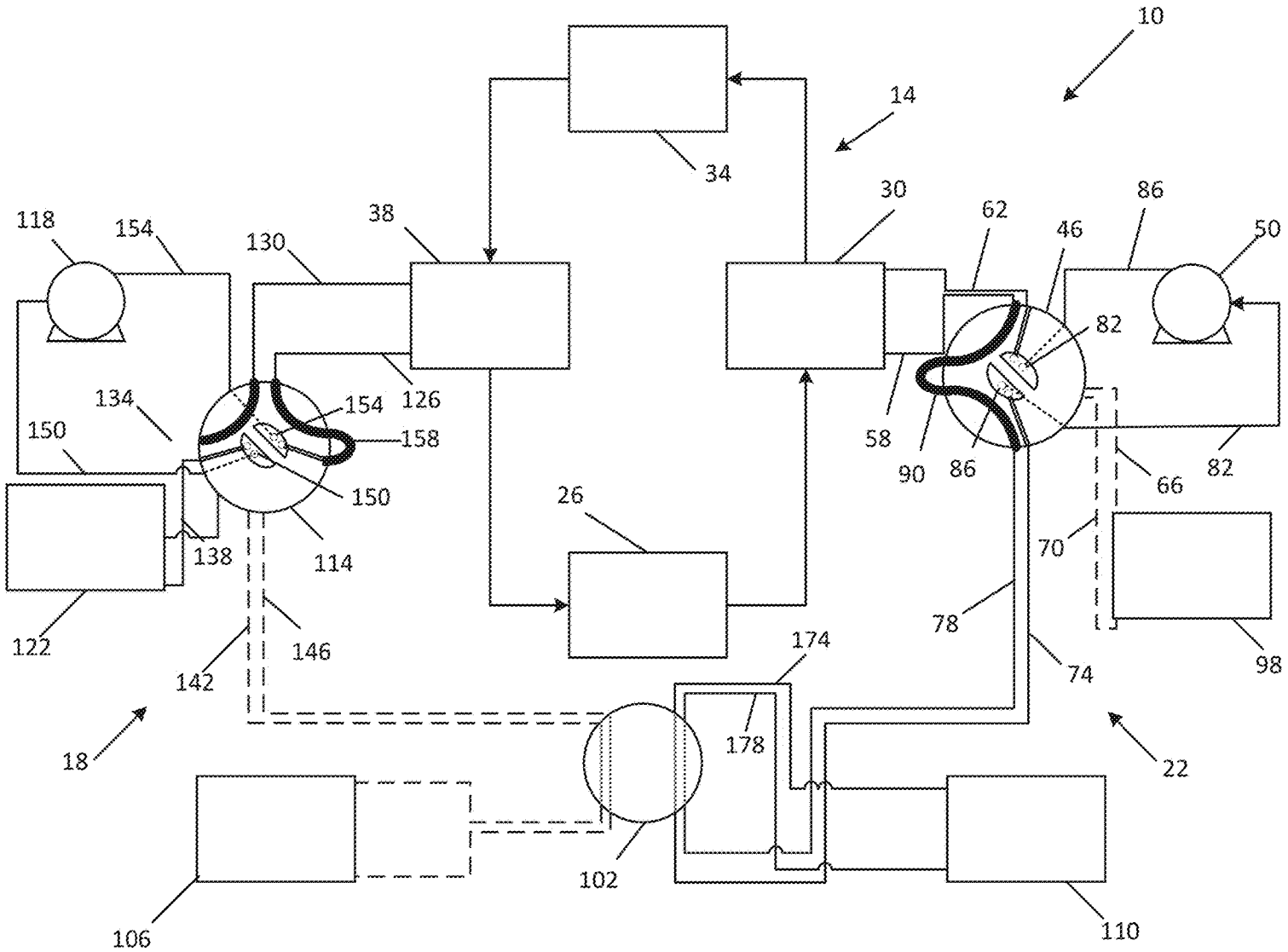
FIG. 8 is a schematic illustration of the refrigeration system in FIG. 1 in another operation mode configuration.

Referring to FIG. 8, the refrigeration system 10 may be configured in a cooling-TES charging operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the cold TES 122 and the condenser may be in communication with the outdoor coil 110. For example, the refrigeration system 10 may be configured such that the cooling secondary fluid loop 18 is not in communication with the indoor coil 106, but instead only charges the cold TES 122, and the heating secondary fluid loop 22 is in communication with the outdoor coil 110. The valve 102 may be in the first position (FIG. 6A) where the valve 102 connects the coil inlet fluid line 74 and coil outlet fluid line 78 from the heating secondary fluid loop 22 with the outdoor coil inlet fluid line 174 and the outdoor coil outlet fluid line 178 of the outdoor coil 110, respectively.

The multi-position valve 46 of the heating secondary fluid loop 22 may be positioned in the condenser-to-coil position (FIG. 4D). The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system. The multi-position valve 46, therefore, connects the appropriate fluid lines such that the condenser 30 is connected to, and heats, the outdoor coil 110.

The multi-position valve 114 may be positioned in the charge position (FIG. 5C). The actuator 162 is positioned such that the evaporator outlet fluid line 130 is connected to the cold TES inlet fluid line 134. The cold TES outlet fluid line 138 is connected to the pump inlet fluid line 150, and the pump outlet fluid line 154 is connected to the evaporator inlet fluid line 126 through the bypass fluid line 158. The coil inlet fluid line 142 and the coil outlet fluid line 146 are disconnected from the remainder of the system. The multi-position valve 114, therefore, connects the appropriate fluid lines such that the cold TES 122 may be cooled, and thus charged, by the evaporator 38.

Accordingly, the multi-position valves 46 and 114 and the valve 102 connect the condenser 30 to the outdoor coil 110 through the pump 50 and connect the evaporator 38 to the cold TES 122 through the pump 118. Thus, heat from the heating secondary fluid loop 22 is discharged through the outdoor coil 110 and the cold TES 122 is charged through cooling provided from the cooling secondary fluid loop 18 through the evaporator 38. The cooling-TES charging orientation is ideal for charging the cold TES 122 during night or when the house (or other cooled space) is empty. In the cooling-TES charging orientation, the refrigeration system 10 is not cooling or heating the interior space. Heat is dispersed to the environment through the outdoor coil 110 and the cold TES 122 is charged with the working fluid from the evaporator 38.

Figure 9:
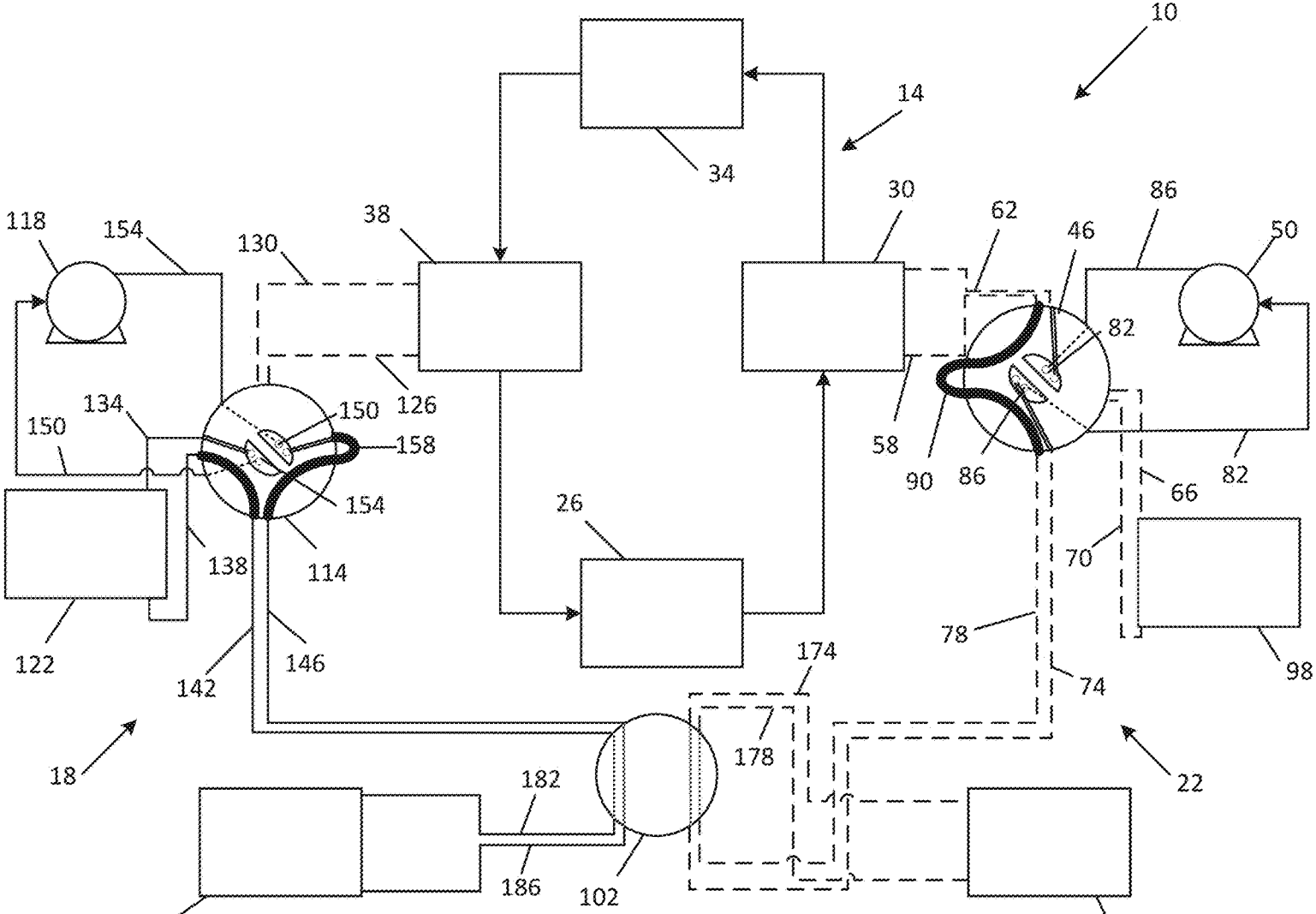
FIG. 9 is a schematic illustration of the refrigeration system in FIG. 1 in another operation mode configuration.

Referring to FIG. 9, the refrigeration system 10 may be configured in a cooling-TES discharging operation mode. The compressor 26 of the main fluid loop 14 may be off, and working fluid may not be circulating through the main fluid loop 14. The evaporator 38 and the condenser 30 may be separated from communication with the cooling secondary fluid loop 18 and the heating secondary fluid loop 22, respectively. For example, the refrigeration system 10 may be configured such that the cooling secondary fluid loop 18 is in communication with the indoor coil 106 and the main fluid loop 14, the heating secondary fluid loop 22, and the outdoor coil 110 are off. The valve 102 may be in the first position (FIG. 6A) where the valve 102 connects the coil inlet fluid line 142 and the coil outlet fluid line 146 of the cooling secondary fluid loop 18 with the indoor coil inlet fluid line 182 and the indoor coil outlet fluid line 186 of the indoor coil 106, respectively.

The multi-position valve 46 may be in any position since the heating secondary fluid loop 22 is off. For example, the multi-position valve 46 may be positioned in the condenser-to-coil position (FIG. 4D). The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system.

The multi-position valve 114 may be positioned in the discharge position (FIG. 5A). The actuator 162 is positioned such that the coil outlet fluid line 146 is connected to the pump inlet fluid line 150 through the bypass fluid line 158. The pump outlet fluid line 154 is connected to the cold TES inlet fluid line 134, and the cold TES outlet fluid line 138 is connected to the coil inlet fluid line 142. The evaporator inlet fluid line 126 and the evaporator outlet fluid line 130 are disconnected from the remainder of the system. The multi-position valve 114, therefore, connects the appropriate fluid lines such that the indoor coil 106 may be cooled by pumping working fluid from the cold TES 122 to the indoor coil 106 and by pumping the working fluid from the indoor coil 106 back through the pump 118. The cold TES 122 is discharged and the indoor coil 106 is cooled.

Accordingly, the interior space is cooled through cooling provided from the cooling secondary fluid loop 18 through the cold TES 122. The cooling-TES discharging operation mode is a high efficiency mode where the compressor 26 is off and the refrigeration system 10 is only running the pump 118. The interior space is only cooled by discharging the cold TES 122. The cooling-TES discharging operation mode may be suited for a situation when the cooling load is not high.

Figure 10:
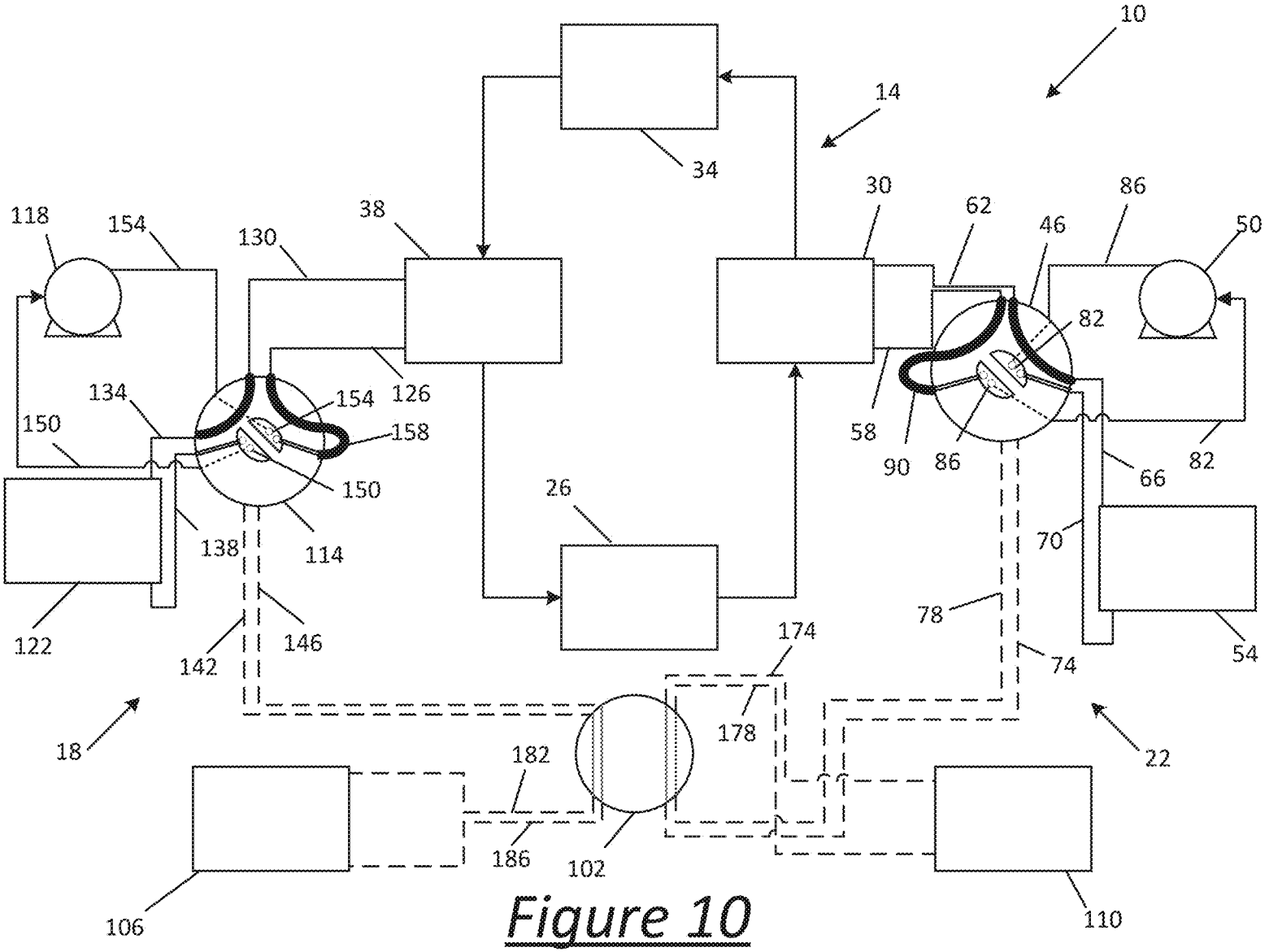
FIG. 10 is a schematic illustration of the refrigeration system in FIG. 1 in another operation mode configuration.

Referring to FIG. 10, the refrigeration system 10 may be configured in a charging both TES operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the cold TES 122 and the condenser 30 may be in communication with the hot TES 54. Neither of the cooling secondary fluid loop 18 nor the heating secondary fluid loop 22 may be in communication with the indoor coil 106 or the outdoor coil 110.

The valve 102 may be in any position, since the indoor coil 106 and the outdoor coil 110 are effectively off, since they are not in communication with either of the cooling secondary fluid loop 18 or the heating secondary fluid loop 22. For example, the valve 102 may be in the first position (FIG. 6A) where the valve 102 connects the coil inlet fluid line 142 and the coil outlet fluid line 146 of the cooling secondary fluid loop 18 with the indoor coil inlet fluid line 182 and the indoor coil outlet fluid line 186 of the indoor coil 106, respectively. The valve 102 may connect the coil inlet fluid line 74 and coil outlet fluid line 78 from the heating secondary fluid loop 22 with the outdoor coil inlet fluid line 174 and the outdoor coil outlet fluid line 178 of the outdoor coil 110, respectively.

The multi-position valve 46 may be positioned in the charge position (FIG. 4C). The actuator 94 is positioned such that the condenser outlet fluid line 62 is connected to the hot TES inlet fluid line 66. The hot TES outlet fluid line 70 is connected to the pump inlet fluid line 82, and the pump outlet fluid line 86 is connected to the condenser inlet fluid line 58 through the bypass fluid line 90. The coil inlet fluid line 74 and the coil outlet fluid line 78 are disconnected from the remainder of the system. The multi-position valve 46, therefore, connects the appropriate fluid lines such that the hot TES 54 may be heated, and thus charged, by the condenser 30.

The multi-position valve 114 may be positioned in the charge position (FIG. 5C). The actuator 162 is positioned such that the evaporator outlet fluid line 130 is connected to the cold TES inlet fluid line 134. The cold TES outlet fluid line 138 is connected to the pump inlet fluid line 150, and the pump outlet fluid line 154 is connected to the evaporator inlet fluid line 126 through the bypass fluid line 158. The coil inlet fluid line 142 and the coil outlet fluid line 146 are disconnected from the remainder of the system. The multi-position valve 114, therefore, connects the appropriate fluid lines such that the cold TES 122 may be cooled, and thus charged, by the evaporator 38.

Accordingly, the multi-position valves 46 and 114 connect the condenser 30 to the hot TES 54 through the pump 50 and connect the evaporator 38 to the cold TES 122 through the pump 118. Thus, heat from the condenser 30 charges the hot TES 54 and cooling from the evaporator 38 charges the cold TES 122. The charging both TES operation mode is desirable when the outdoor temperature is hotter than a desired temperature of the hot TES 54 or the hot water tank (for example, Phoenix, AZ, or Las Vegas, NV, in the summer). This operation mode provides no cooling to the indoor space and is therefore desirable when the indoor space is unoccupied. In the charging both TES operation mode, it is more efficient to dump the hot working fluid from the heating secondary fluid loop 22 in the hot TES because the return working fluid comes back cooler than it would from the outdoor coil 110.

Figure 11:
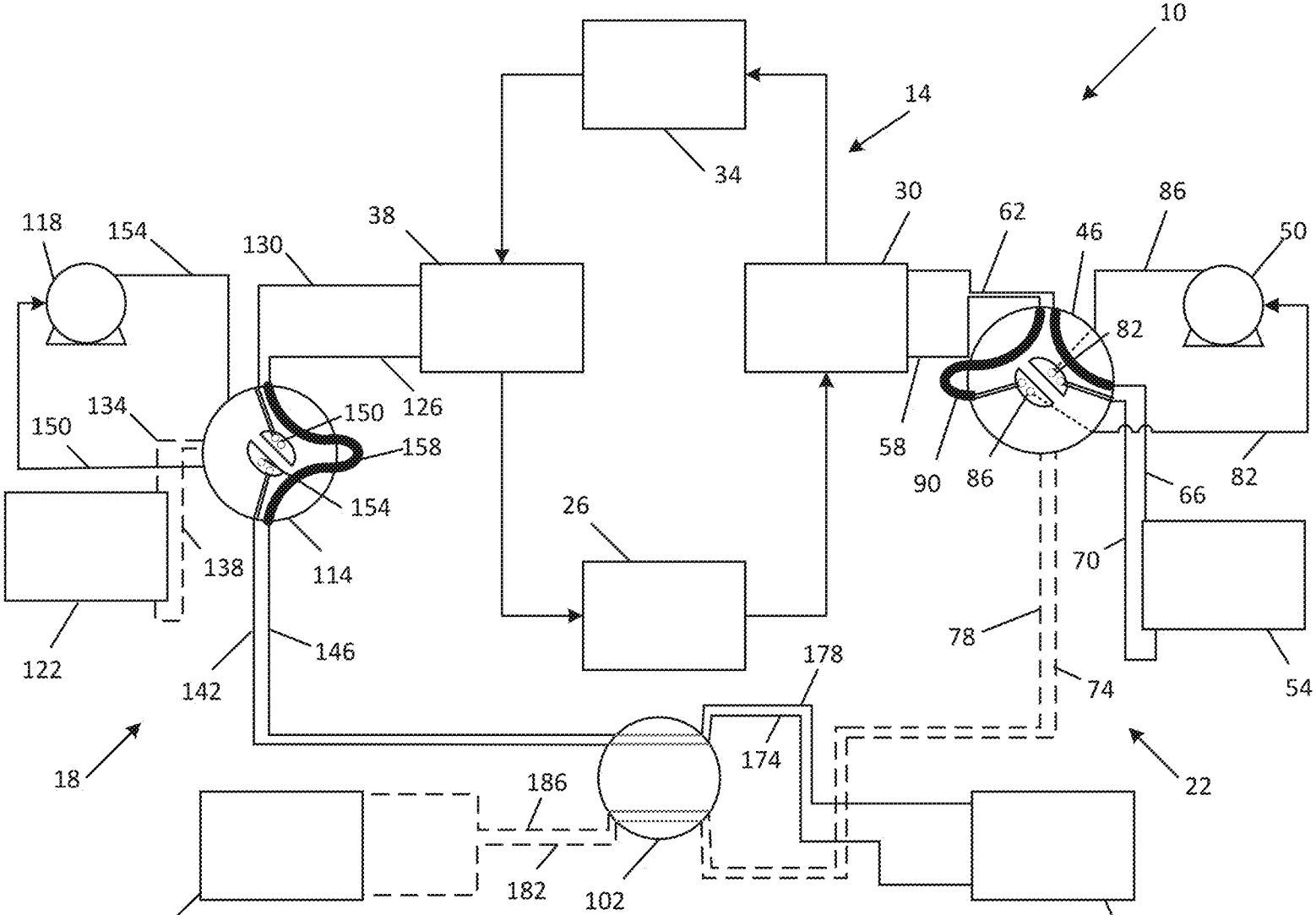
FIG. 11 is a schematic illustration of the refrigeration system in FIG. 1 in another operation mode configuration.

Now referring to FIG. 11, the refrigeration system 10 may be configured in a charging hot water tank (hot TES) operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the outdoor coil 110 and the condenser 30 may be in communication with the hot TES 54 (or hot water tank). For example, the refrigeration system 10 may be configured such that the cooling secondary fluid loop 18 is in communication with the outdoor coil 110. The valve 102 may be in the second position (FIG. 6B) where the valve connects the coil inlet fluid line 74 and coil outlet fluid line 78 from the heating secondary fluid loop 22 with the indoor coil inlet fluid line 182 and the indoor coil outlet fluid line 186 of the indoor coil 106, respectively. The valve 102 may also connect the coil inlet fluid line 142 and the coil outlet fluid line 146 of the cooling secondary fluid loop 18 with the outdoor coil inlet fluid line 174 and the outdoor coil outlet fluid line 178 of the outdoor coil 110, respectively.

The multi-position valve 46 may be positioned in the charge position (FIG. 4C). The actuator 94 is positioned such that the condenser outlet fluid line 62 is connected to the hot TES inlet fluid line 66. The hot TES outlet fluid line 70 is connected to the pump inlet fluid line 82, and the pump outlet fluid line 86 is connected to the condenser inlet fluid line 58 through the bypass fluid line 90. The coil inlet fluid line 74 and the coil outlet fluid line 78 are disconnected from the remainder of the system. The multi-position valve 46, therefore, connects the appropriate fluid lines such that the hot TES 54 may be heated, and thus charged, by the condenser 30.

The multi-position valve 114 may be positioned in the evaporator to coil position (FIG. 5D). The actuator 162 is positioned such that the evaporator outlet fluid line 130 is connected to the pump inlet fluid line 150. The pump outlet fluid line 154 is connected to the coil inlet fluid line 142, and the coil outlet fluid line 146 is connected to the evaporator inlet fluid line 126 through the bypass fluid line 158. The cold TES inlet fluid line 134 and the cold TES outlet fluid line 138 are disconnected from the remainder of the system. The multi-position valve 114, therefore, connects the appropriate fluid lines such that the evaporator 38 is connected to, and cools, the outdoor coil 110.

Accordingly, the multi-position valves 46 and 114 and the valve 102 connect the condenser 30 to the hot TES 54 through the pump 50 and connect the evaporator 38 to the outdoor coil 110 through the pump 118. Thus, heat from the heating secondary fluid loop 22 charges the hot TES 54 and cooling from the cooling secondary fluid loop 18 is discharged through the outdoor coil 110. Thus, in the charging hot water tank (hot TES) operation mode, no heating or cooling is provided to the interior space. This operation mode is, therefore, ideal for a mild outdoor climate where heating and cooling are not necessary. This is an efficient way to charge the hot TES 54 by pulling heat from the outdoor coil 110. This operation mode additionally increases the life of the compressor 26 by not requiring the compressor to work as hard to generate heat for the hot TES 54.

Figure 12:
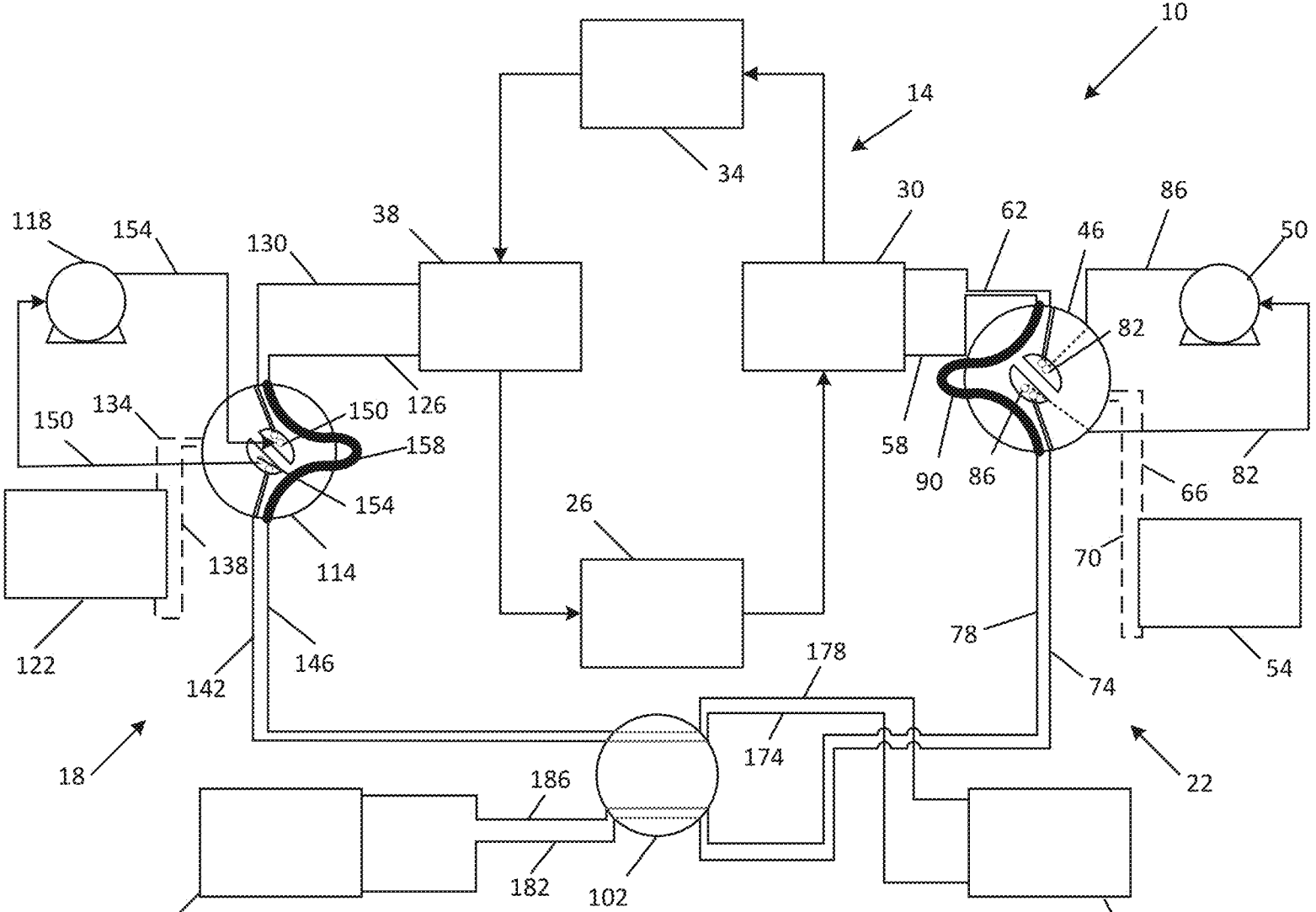
FIG. 12 is a schematic illustration of the refrigeration system in FIG. 1 in another operation mode configuration.

Now referring to FIG. 12, the refrigeration system 10 may be configured in a heating traditional operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the outdoor coil 110 and the compressor 30 may be in communication with the indoor coil 106. For example, the refrigeration system 10 may be configured such that the cooling secondary fluid loop 18 is in communication with the outdoor coil 110 and the heating secondary fluid loop 22 is in communication with the indoor coil 106. The valve 102 may be in the second position (FIG. 6B) where the valve connects the coil inlet fluid line 74 and coil outlet fluid line 78 from the heating secondary fluid loop 22 with the indoor coil inlet fluid line 182 and the indoor coil outlet fluid line 186 of the indoor coil 106, respectively. The valve 102 may also connect the coil inlet fluid line 142 and the coil outlet fluid line 146 of the cooling secondary fluid loop 18 with the outdoor coil inlet fluid line 174 and the outdoor coil outlet fluid line 178 of the outdoor coil 110, respectively.

The multi-position valve 46 may be positioned in the condenser-to-coil position (FIG. 4D). The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system. The multi-position valve 46, therefore, connects the appropriate fluid lines such that the condenser 30 is connected to, and heats, the indoor coil 106.

The multi-position valve 114 may be positioned in the evaporator-to-coil position (FIG. 5D). The actuator 162 is positioned such that the evaporator outlet fluid line 130 is connected to the pump inlet fluid line 150. The pump outlet fluid line 154 is connected to the coil inlet fluid line 142, and the coil outlet fluid line 146 is connected to the evaporator inlet fluid line 126 through the bypass fluid line 158. The cold TES inlet fluid line 134 and the cold TES outlet fluid line 138 are disconnected from the remainder of the system. The multi-position valve 114, therefore, connects the appropriate fluid lines such that the evaporator 38 is connected to, and cools, the outdoor coil 110.

Accordingly, the multi-position valves 46 and 114 and the valve 102 connect the condenser 30 to the indoor coil 106 through the pump 50 and connect the evaporator 38 to the outdoor coil 110 through the pump 118. Thus, heat from the outdoor air is absorbed in the cooling secondary fluid loop 18 through the outdoor coil 110 and the interior space is heated through heat provided from the heating secondary fluid loop 22 through the indoor coil 106.

Figure 13:
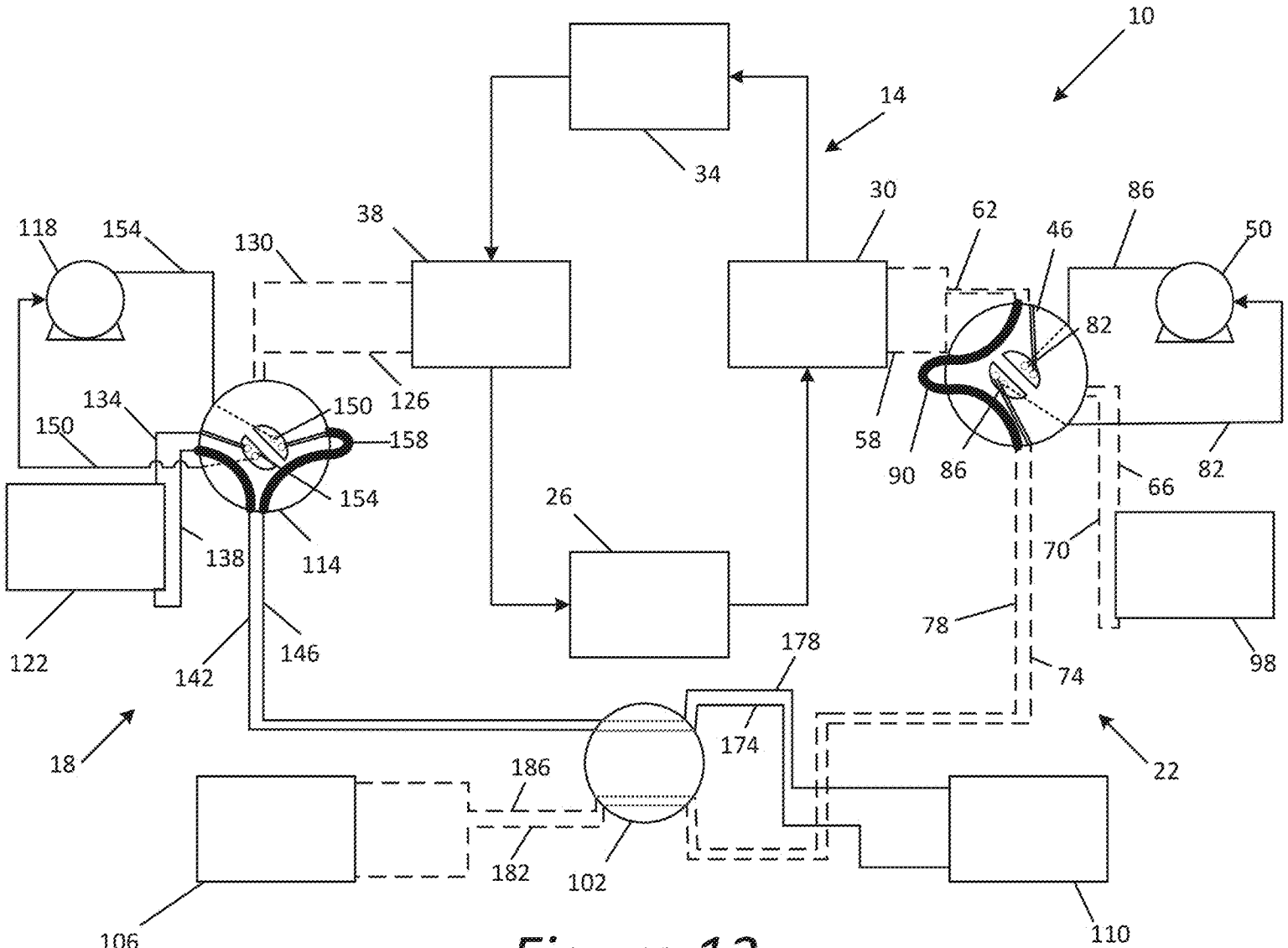
FIG. 13 is a schematic illustration of the refrigeration system in FIG. 1 in another operation mode configuration.

Referring to FIG. 13, the refrigeration system 10 may be configured in a heating-charging cold TES operation mode. The compressor 26 of the main fluid loop 14 may be off, and working fluid may not be circulating through the main fluid loop 14. The evaporator 38 and the condenser 30 may be separated from communication with the cooling secondary fluid loop 18 and the heating secondary fluid loop 22, respectively. For example, the refrigeration system 10 may be configured such that the cooling secondary fluid loop 18 is in communication with the outdoor coil 110 and the main fluid loop 14, the heating secondary fluid loop 22, and the outdoor coil 110 are off. The valve 102 may be in the second position (FIG. 6B) where the valve connects the coil inlet fluid line 74 and coil outlet fluid line 78 from the heating secondary fluid loop 22 with the indoor coil inlet fluid line 182 and the indoor coil outlet fluid line 186 of the indoor coil 106, respectively. The valve 102 may also connect the coil inlet fluid line 142 and the coil outlet fluid line 146 of the cooling secondary fluid loop 18 with the outdoor coil inlet fluid line 174 and the outdoor coil outlet fluid line 178 of the outdoor coil 110, respectively.

The multi-position valve 46 may be in any position since the heating secondary fluid loop 22 is off. For example, the multi-position valve 46 may be positioned in the condenser-to-coil position (FIG. 4D). The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system.

The multi-position valve 114 may be positioned in the discharge position (FIG. 5A). The actuator 162 is positioned such that the coil outlet fluid line 146 is connected to the pump inlet fluid line 150 through the bypass fluid line 158. The pump outlet fluid line 154 is connected to the cold TES inlet fluid line 134, and the cold TES outlet fluid line 138 is connected to the coil inlet fluid line 142. The evaporator inlet fluid line 126 and the evaporator outlet fluid line 130 are disconnected from the remainder of the system. The multi-position valve 114, therefore, connects the appropriate fluid lines such that the cold TES 122 may be charged by pumping working fluid from the outdoor coil 110 through the pump 118.

Accordingly, the cold TES 122 is charged through working fluid provided from the outdoor coil 110. The heating-charging cold TES operation mode is a high efficiency mode where the compressor 26 is off and the refrigeration system 10 is only running the pump 118. The heating-charging cold TES operation mode may be suited for a situation when the outdoor temperature is colder than the cold TES 122 (for example, when the outdoor temperature is less than 32° C.).

Figure 14:
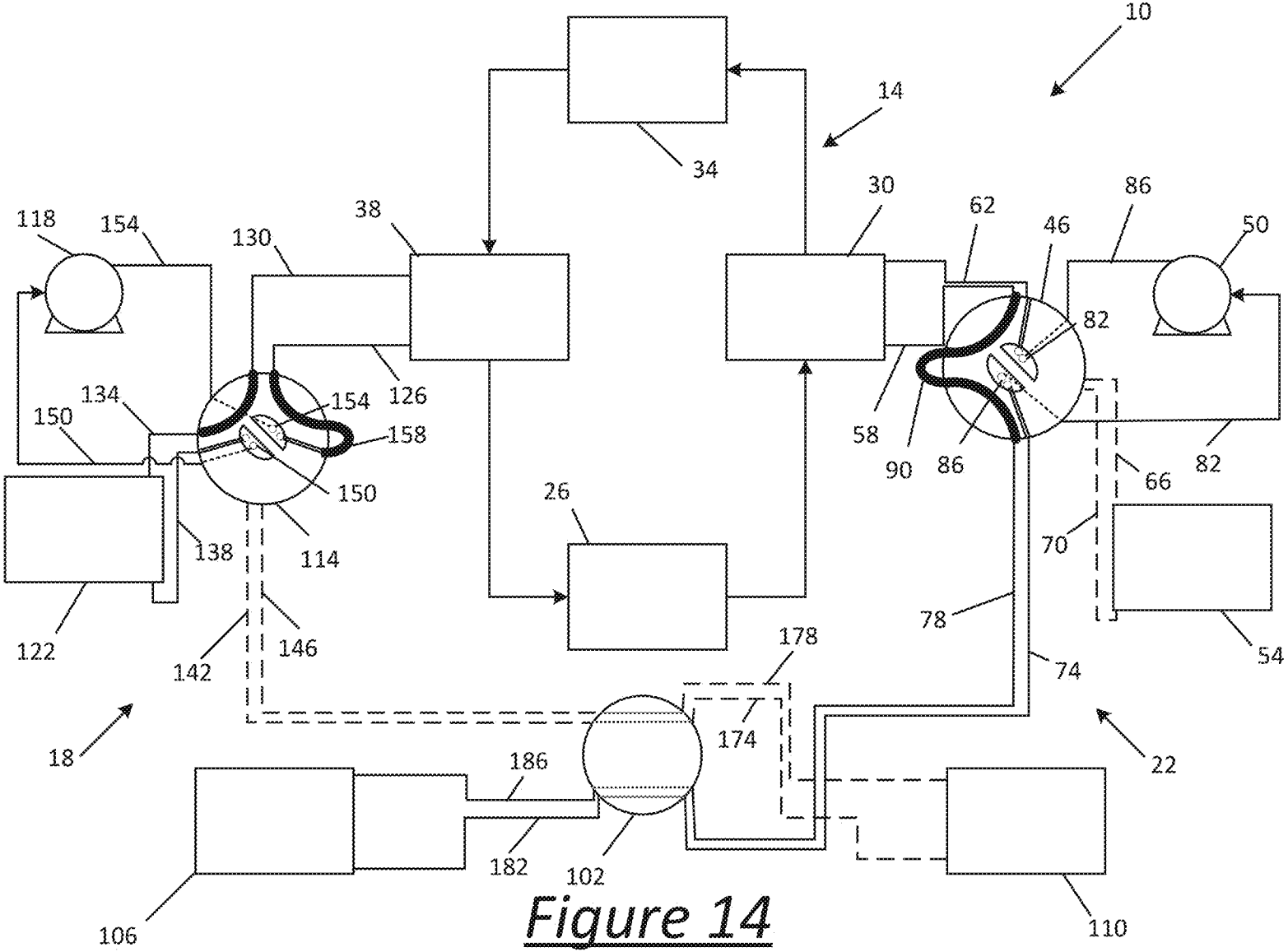
FIG. 14 is a schematic illustration of the refrigeration system in FIG. 1 in another operation mode configuration.

Now referring to FIG. 14, the refrigeration system 10 may be configured in a heating-cold day operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the cold TES 122, and the condenser 30 may be in communication with the indoor coil 106. For example, the refrigeration system 10 may be configured such that the heating secondary fluid loop 22 is in communication with the indoor coil 106 and the cooling secondary fluid loop 18 provides working fluid to the evaporator 38 from the cold TES 122. The valve 102 may be in the second position (FIG. 6B) where the valve 102 connects the coil inlet fluid line 74 and coil outlet fluid line 78 from the heating secondary fluid loop 22 with the indoor coil inlet fluid line 182 and the indoor coil outlet fluid line 186 of the indoor coil 106, respectively. The valve 102 may also connect the coil inlet fluid line 142 and the coil outlet fluid line 146 of the cooling secondary fluid loop 18 with the outdoor coil inlet fluid line 174 and the outdoor coil outlet fluid line 178 of the outdoor coil 110, respectively.

The multi-position valve 46 may be positioned in the condenser-to-coil position (FIG. 4D). The actuator 94 is positioned such that the condenser outlet fluid line 62 is connected to the pump inlet fluid line 82. The pump outlet fluid line 86 is connected to the coil inlet fluid line 74, and the coil outlet fluid line 78 is connected to the condenser inlet fluid line 58 through the bypass fluid line 90. The hot TES inlet fluid line 66 and the hot TES outlet fluid line 70 are disconnected from the remainder of the system. The multi-position valve 46, therefore, connects the appropriate fluid lines such that the condenser 30 is connected to, and heats, the indoor coil 106.

The multi-position valve 114 may be positioned in the charge position (FIG. 5C). The actuator 162 is positioned such that the evaporator outlet fluid line 130 is connected to the cold TES inlet fluid line 134. The cold TES outlet fluid line 138 is connected to the pump inlet fluid line 150, and the pump outlet fluid line 154 is connected to the evaporator inlet fluid line 126 through the bypass fluid line 158. The coil inlet fluid line 142 and the coil outlet fluid line 146 are disconnected from the remainder of the system. The multi-position valve 114, therefore, connects the appropriate fluid lines such that the cold TES 122 may provide working fluid to the evaporator 38.

Accordingly, the multi-position valves 46 and 114 and the valve 102 connect the condenser 30 to the indoor coil 106 through the pump 50 and connect the evaporator 38 to the cold TES 122 through the pump 118. The heating-cold day operation mode is ideal for extreme cold weather operation, for example, where the ambient air is colder than the temperature of the cold TES 122. Thus, the cold TES 122 provides working fluid at a higher temperature than working fluid provided from the outdoor coil 110. The working fluid from the cold TES 122 provides additional heat to the working fluid of the main fluid loop 14 in the evaporator 38. Thus, the heating-cold day operation mode allows for more efficient compressor operation and reduced wear on the compressor.

Figure 15:
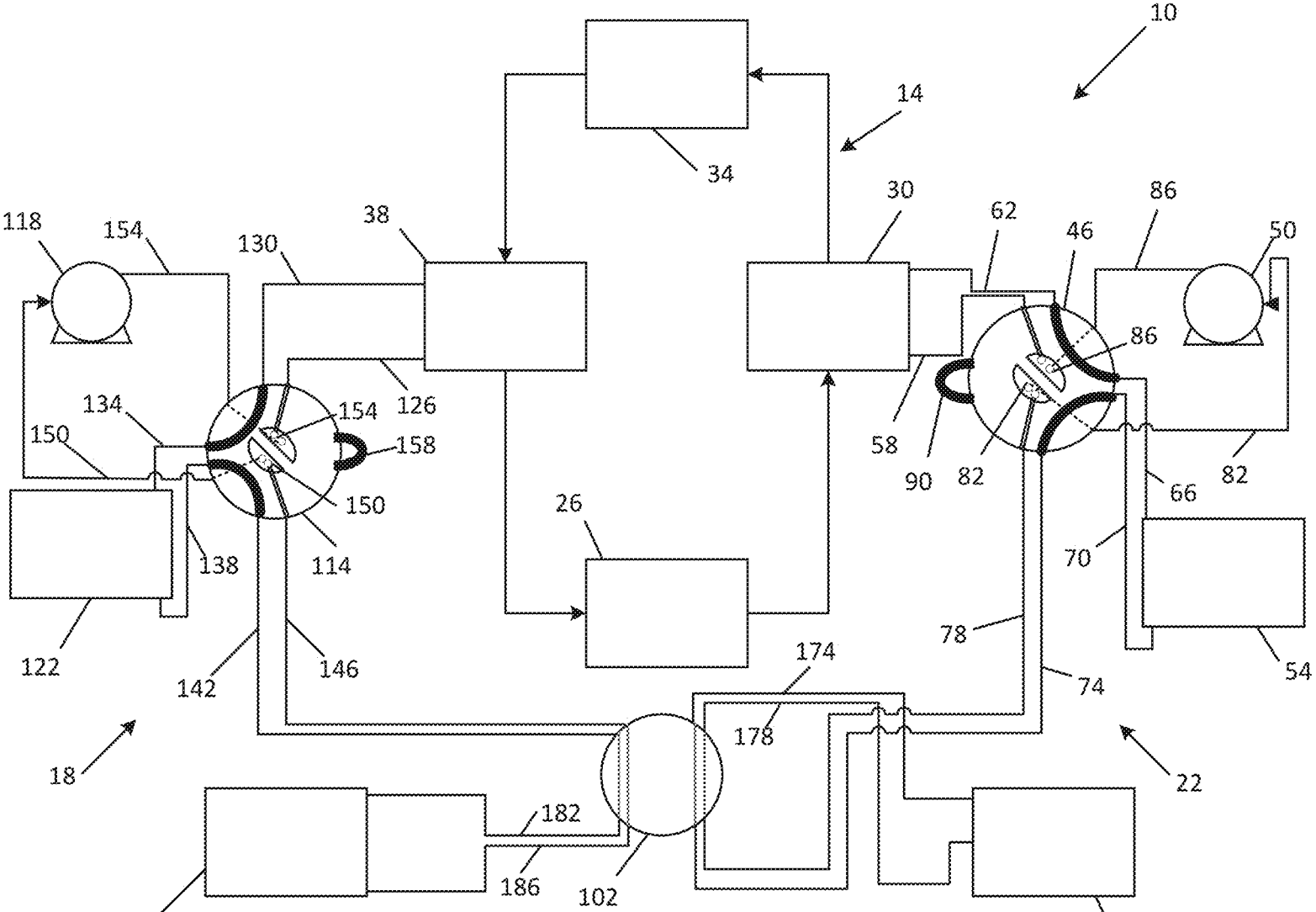
FIG. 15 is a schematic illustration of the refrigeration system in FIG. 1 in another operation mode configuration.

Referring to FIG. 15, the refrigeration system 10 may be configured in a cooling-hybrid operation mode. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the indoor coil 106 and the condenser 30 may be in communication with the outdoor coil 110. For example, the refrigeration system 10 may be configured such that the cooling secondary fluid loop 18 is in communication with the indoor coil 106 and the heating secondary fluid loop 22 is in communication with the outdoor coil 110. The valve 102 may be in the first position (FIG. 6A) where the valve 102 connects the coil inlet fluid line 142 and the coil outlet fluid line 146 of the cooling secondary fluid loop 18 with the indoor coil inlet fluid line 182 and the indoor coil outlet fluid line 186 of the indoor coil 106, respectively. The valve 102 connects the coil inlet fluid line 74 and coil outlet fluid line 78 from the heating secondary fluid loop 22 with the outdoor coil inlet fluid line 174 and the outdoor coil outlet fluid line 178 of the outdoor coil 110, respectively.

The multi-position valve 46 may be positioned in the hybrid position (FIG. 4B). The actuator 94 is positioned such that the condenser outlet fluid line 62 is connected to the hot TES inlet fluid line 66, the hot TES outlet fluid line 70 is connected to the coil inlet fluid line 74. The coil outlet fluid line 78 is connected to the pump inlet fluid line 82, and the pump outlet fluid line 86 is connected to the condenser inlet fluid line 58. The bypass fluid line 90 is disconnected from the remainder of the system. The multi-position valve 46, accordingly, connects the appropriate fluid lines such that the outdoor coil 110 may be heated by pumping working fluid from the hot TES 54 to the outdoor coil 110 and by pumping the working fluid from the outdoor coil 110 back through the pump 50. The hot TES 54 is heated by pumping the working fluid from the condenser 30. Thus, in this hybrid position, the condenser 30 heats the hot TES 54 and the hot TES 54 heats the outdoor coil 110.

The multi-position valve 114 may be positioned in the hybrid position (FIG. 5B). The actuator 162 is positioned such that the evaporator outlet fluid line 130 is connected to the cold TES inlet fluid line 134, the cold TES outlet fluid line 138 is connected to the coil inlet fluid line 142. The coil outlet fluid line 146 is connected to the pump inlet fluid line 150, and the pump outlet fluid line 154 is connected to the evaporator inlet fluid line 126. The bypass fluid line 158 is disconnected from the remainder of the system. The multi-position valve 114, accordingly, connects the appropriate fluid lines such that the indoor coil 106 may be cooled by pumping working fluid from the cold TES 122 to the indoor coil 106 and by pumping the working fluid from the indoor coil 106 back through the pump 118. The cold TES 122 is cooled by pumping the working fluid from the evaporator 38. Thus, in this hybrid position, the evaporator 38 cools the cold TES 122 and the cold TES 122 cools the indoor coil 106 and interior space.

Accordingly, the multi-position valves 46 and 114 and valve 102 connect the condenser 30 to the outdoor coil 110 through the hot TES 54 and connect the evaporator 38 to the indoor coil 106 through the cold TES 122. Thus, heat from the heating secondary fluid loop 22 is disbursed through the outdoor coil 110 and the interior space is cooled through cooling provided from the cooling secondary fluid loop 18 through the indoor coil 106. The cooling-hybrid operation mode is ideal for situations where there are extra cooling needs. For example, where the cooling load is high during a hot summer day. The evaporator cools the cold TES 122 and the cold TES cools the interior space through the indoor coil 106.

Figure 16:
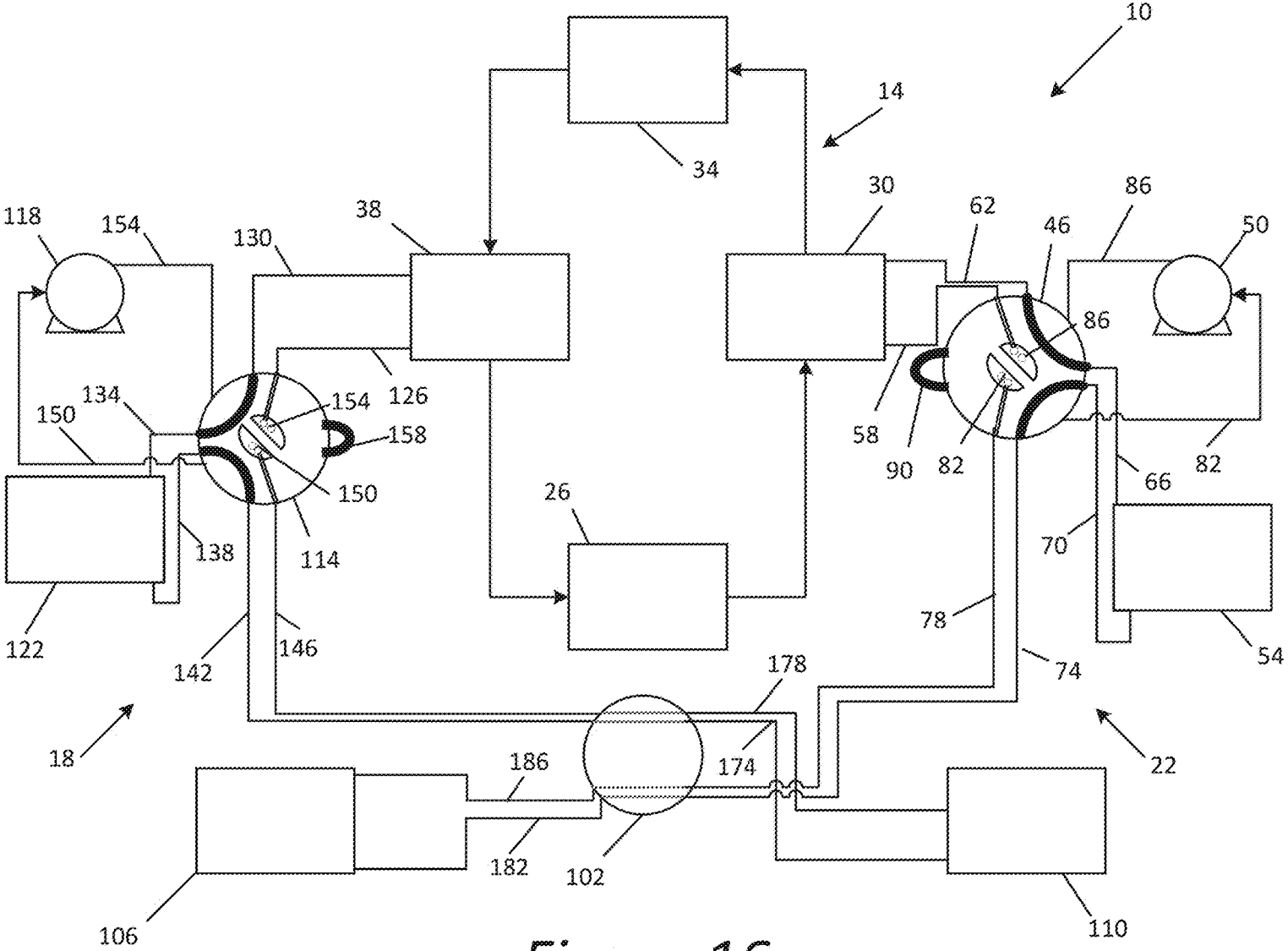
FIG. 16 is a schematic illustration of the refrigeration system in FIG. 1 in another operation mode configuration.

Now referring to FIG. 16, the refrigeration system 10 may be configured in a heating-hybrid operation mode. The heating-hybrid operation mode may be similar to the cooling-hybrid operation mode, except that the cooling secondary fluid loop 18 is in communication with the outdoor coil 110 and the heating secondary fluid loop 22 is in communication with the indoor coil 106. The main fluid loop 14 may operate in a normal operating manner, with the working fluid passing from the compressor 26 to the condenser 30, to the expansion valve 34, to the evaporator 38, and back to the compressor 26. The evaporator 38 may be in communication with the outdoor coil 110 and the condenser 30 may be in communication with the indoor coil 106. The valve 102 may be in the second position (FIG. 6B) where the valve 102 connects the coil inlet fluid line 142 and the coil outlet fluid line 146 of the cooling secondary fluid loop 18 with the outdoor coil inlet fluid line 174 and the outdoor coil outlet fluid line 178 of the outdoor coil 110, respectively. The valve 102 also connects the coil inlet fluid line 74 and coil outlet fluid line 78 from the heating secondary fluid loop 22 with the indoor coil inlet fluid line 182 and the indoor coil outlet fluid line 186 of the indoor coil 106, respectively.

The multi-position valve 46 may be positioned in the hybrid position (FIG. 4B). The actuator 94 is positioned such that the condenser outlet fluid line 62 is connected to the hot TES inlet fluid line 66, the hot TES outlet fluid line 70 is connected to the coil inlet fluid line 74. The coil outlet fluid line 78 is connected to the pump inlet fluid line 82, and the pump outlet fluid line 86 is connected to the condenser inlet fluid line 58. The bypass fluid line 90 is disconnected from the remainder of the system. The multi-position valve 46, accordingly, connects the appropriate fluid lines such that the indoor coil 106 may be heated by pumping working fluid from the hot TES 54 to the indoor coil 106 and by pumping the working fluid from the indoor coil 106 back through the pump 50. The hot TES 54 is heated by pumping the working fluid from the condenser 30. Thus, in this hybrid position, the condenser 30 heats the hot TES 54 and the hot TES 54 heats the indoor coil 106.

The multi-position valve 114 may be positioned in the hybrid position (FIG. 5B). The actuator 162 is positioned such that the evaporator outlet fluid line 130 is connected to the cold TES inlet fluid line 134, the cold TES outlet fluid line 138 is connected to the coil inlet fluid line 142. The coil outlet fluid line 146 is connected to the pump inlet fluid line 150, and the pump outlet fluid line 154 is connected to the evaporator inlet fluid line 126. The bypass fluid line 158 is disconnected from the remainder of the system. The multi-position valve 114, accordingly, connects the appropriate fluid lines such that the outdoor coil 110 may be cooled by pumping working fluid from the cold TES 122 to the outdoor coil 110 and by pumping the working fluid from the outdoor coil 110 back through the pump 118. The cold TES 122 is cooled by pumping the working fluid from the evaporator 38. Thus, in this hybrid position, the evaporator 38 cools the cold TES 122 and the cold TES 122 cools the outdoor coil 110.

Accordingly, the multi-position valves 46 and 114 and valve 102 connect the condenser 30 to the indoor coil 106 through the hot TES 54 and connect the evaporator 38 to the outdoor coil 110 through the cold TES 122. Thus, heat from the heating secondary fluid loop 22 heats the interior space through the indoor coil 106 and cooling from the cooling secondary fluid loop 18 is provided to the outdoor coil 110. The heating-hybrid operation mode is ideal for situations where there are extra heating needs. For example, where the heating load is high during a cold winter night. The condenser 30 heats the hot TES 54 and the hot TES 54 heats the interior space through the indoor coil 106.

Figure 17:
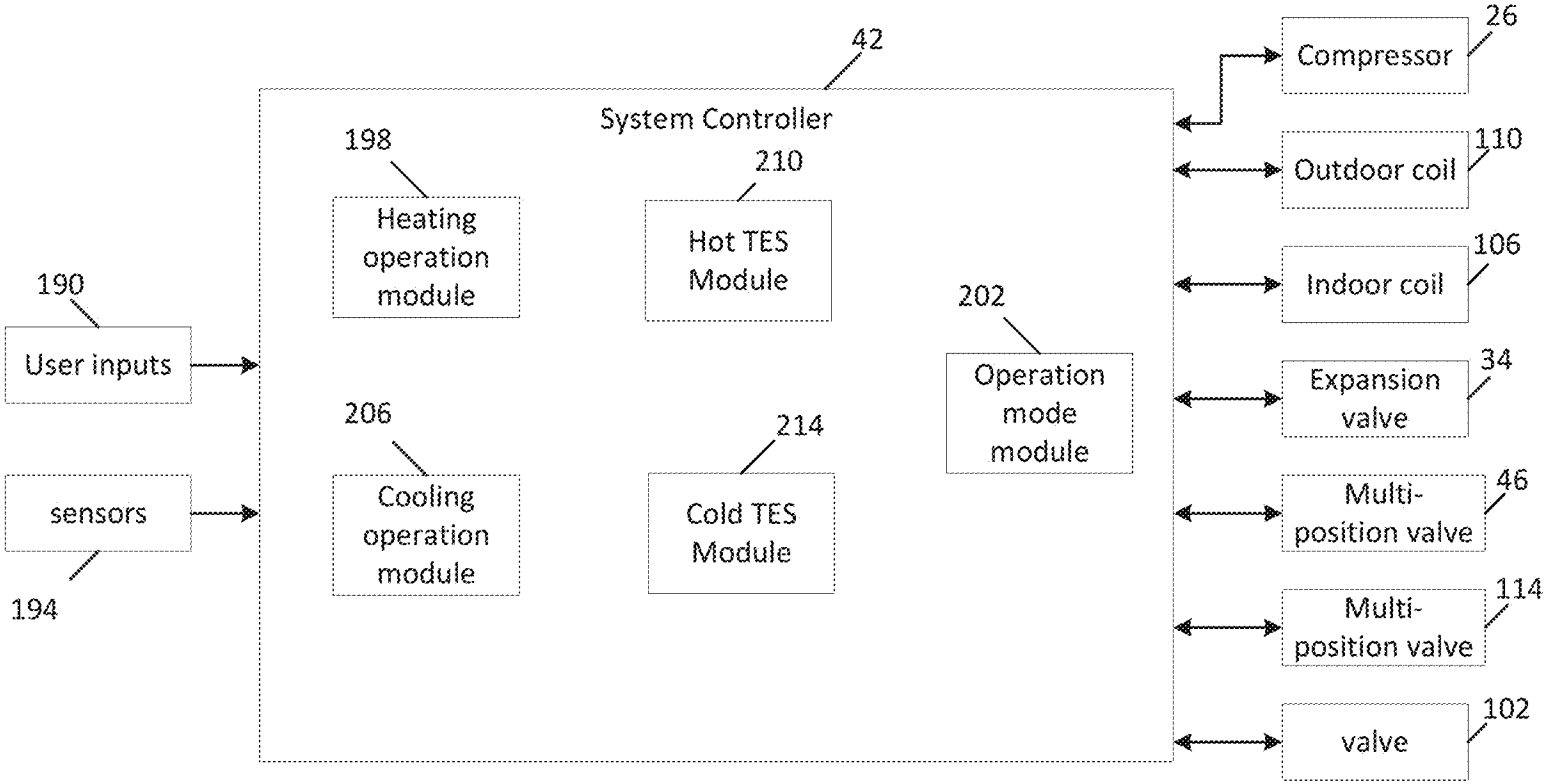
FIG. 17 is a schematic illustration of a control system for the refrigeration system in FIG. 1.

Referring to FIGS. 1 and 17, the system controller 42 controls the refrigeration system. For example only, the system controller 42 may control the refrigeration system based on user inputs and/or parameters derived or measured by, for example, pressure sensors, temperature sensors, current sensors, voltage sensors, or any other sensors. The system controller 42 may be a control module.

In this application, the term "module" or "unit" may be replaced with the term "circuit." The term "module" may refer to, be part of, or include processor hardware (shared, dedicated, or group) that executes code and memory hardware (shared, dedicated, or group) that stores code executed by the processor hardware. The code is configured to provide the features of the modules described herein. The term memory hardware is a subset of the term computer-readable medium. The term computer-readable medium, as used herein, does not encompass transitory electrical or electromagnetic signals propagating through a medium (such as on a carrier wave). The term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The system controller 42 may be in communication with various inputs, including, among others, user inputs 190 and sensor inputs 194. The system controller 42 may also be in communication with various outputs including, among others, the multi-position valve 46, the multi-position valve 114, the valve 102, the compressor 26, the condenser 30, the expansion valve 34, and the evaporator 38. The system controller 42 may communication with the various inputs and the various outputs to determine an operation mode for the refrigeration system 10.

For example, the system controller 42 may receive a set temperature from the user inputs 190. The system controller 42 may additionally or alternatively receive an indoor coil 106 temperature, an outdoor coil 110 temperature, an ambient temperature, an inside space temperature, a hot TES 54 temperature, a cold TES 122 temperature, working fluid temperatures throughout the main fluid loop 14, the cooling secondary fluid loop 18, and the heating secondary fluid loop 22, and other temperatures, pressures, etc., throughout the refrigeration system 10.

A heating operation module 198 may receive the various inputs from the user inputs 190 and the sensors 194 and may provide an operation mode suggestion to an operation mode module 202. For example, the heating operation module 198 may receive a set temperature and a heating or cooling mode request from the user input 190 and an indoor space temperature from the sensors 194. If the refrigeration system 10 is in a cooling mode, the heating operation module does nothing. If the refrigeration system 10 is in a heating mode, the heating operation module 198 may determine whether the indoor space temperature is equal to or greater than the set temperature plus a threshold (for example, within a range of 1-2° F.). If not, the heating operation module 198 may request a heating operation mode to the operation mode module 202.

A cooling operation module 206 may receive the various inputs from the user inputs 190 and the sensors 194 and may provide an operation mode suggestion to the operation mode module 202. For example, the cooling operation module 206 may receive a set temperature and a heating or cooling mode request from the user input 190 and an indoor space temperature from the sensors 194. If the refrigeration system 10 is in a heating mode, the cooling operation module 206 does nothing. If the refrigeration system 10 is in a cooling mode, the cooling operation module 206 may determine whether the indoor space temperature is equal to or less than the set temperature plus a threshold (for example, within a range of 1-2° F.). If not, the cooling operation module 206 may request a cooling operation mode to the operation mode module 202.

A hot TES module 210 may receive the various inputs from the user inputs 190 and the sensors 194 and may provide an operation mode suggestion to the operation mode module 202. For example, the hot TES module 210 may receive a set temperature (or pre-programmed temperature threshold) from the user input 190 and a hot TES 54 temperature from the sensors 194. The hot TES module 210 may determine whether the indoor space temperature is equal to or greater than the set temperature plus a threshold (for example, within a range of 1-5° F.). If not, the hot TES module 210 may request a charging operation mode to the operation mode module 202.

A cold TES module 214 may receive the various inputs from the user inputs 190 and the sensors 194 and may provide an operation mode suggestion to the operation mode module 202. For example, the cold TES module 214 may receive a set temperature (or pre-programmed temperature threshold) from the user input 190 and a cold TES 122 temperature from the sensors 194. The cold TES module 214 may determine whether the indoor space temperature is equal to or less than the set temperature plus a threshold (for example, within a range of 1-5° F.). If not, the cold TES module 214 may request a charging operation mode to the operation mode module 202.

The operation mode module 202 may receive operation mode suggestions from the heating operation module 198, the cooling operation module 206, the hot TES module 210, and the cold TES module 214 and may receive system parameters from the compressor 26 (load, load schedules, etc.), indoor coil 106, outdoor coil 110, expansion valve 34, multi-position valve 46 (current position), multi-position valve 114 (current position), and valve 102 (current position). The operation mode module 202 may also receive the various inputs from the user inputs 190 and the sensors 194. The operation mode module 202 may determine an operation mode for the refrigeration system 10 based on all of the inputs.

For example, the operation mode module 202 may determine a cooling-traditional operation mode when the refrigeration system 10 is in a cooling mode, the set temperature is less than the indoor space temperature, and the cold TES 122 is discharged and the hot TES 54 is charged or if the cold TES 122 and hot TES 54 are charged and the electricity price are favorable or if comfort is required quickly.

The operation mode module 202 may determine a cooling-TES charging operation mode when the refrigeration system 10 is in a cooling mode and the set temperature is not less than the indoor space temperature. Alternatively, the operation mode module 202 may determine a cooling-TES charging operation mode when the refrigeration system 10 is in a cooling mode, the set temperature is not less than the indoor space temperature, and the cold TES threshold temperature is less than the cold TES 122 temperature (i.e., the cold TES 122 is in need of charging).

The operation mode module 202 may determine a cooling-TES discharging operation mode when the refrigeration system 10 is in a cooling mode, the set temperature is less than the indoor space temperature, and the ambient temperature is high or electricity rates are high.

The operation mode module 202 may determine a charging both TES operation mode when no heating or cooling is required (for example, the set temperature is not less than the indoor space temperature in the cooling mode, the set temperature is not greater than the indoor space temperature in the heating mode, etc.). Alternatively, the operation mode module 202 may determine a charging both TES operation mode when no heating or cooling is required, the cold TES threshold temperature is less than the cold TES 122 temperature (i.e., the cold TES 122 is in need of charging), and the hot TES threshold temperature is greater than the hot TES 54 temperature (i.e., the hot TES 54 is in need of charging).

The operation mode module 202 may determine a charging hot water tank operation mode when the refrigeration system 10 is in a heating mode and the set temperature is not greater than the indoor space temperature. Alternatively, the operation mode module 202 may determine a charging hot water tank operation mode when the refrigeration system 10 is in a heating mode, the set temperature is not greater than the indoor space temperature, and the hot TES threshold temperature is greater than the hot TES 54 temperature (i.e., the hot TES 54 is in need of charging).

The operation mode module 202 may determine a heating-traditional operation mode when the refrigeration system 10 is in a heating mode, the set temperature is greater than the indoor space temperature, and the cold TES 122 is charged and hot TES 54 is discharged or if the cold TES 122 and hot TES 54 are charged and electricity prices are low or if comfort is required quickly.

The operation mode module 202 may determine a heating-charging cold TES operation mode when the refrigeration system 10 is in a heating mode, the set temperature is not greater than the indoor space temperature, and the cold TES threshold temperature is less than the cold TES 122 temperature (i.e., the cold TES 122 is in need of charging).

The operation mode module 202 may determine a heating-cold day operation mode when the refrigeration system 10 is in a heating mode, the set temperature is greater than the indoor space temperature, and the ambient temperature is less than the set temperature plus a threshold (for example, when the ambient temperature is within a range of 40° F. or less than the set temperature). Alternatively, the operation mode module 202 may determine a heating-cold day operation mode when the refrigeration system 10 is in a heating mode, the set temperature is greater than the indoor space temperature, and the ambient temperature is less than a predetermined threshold (for example, when the ambient temperature is less than 20° F.).

The operation mode module 202 may determine a cooling-hybrid operation mode when the refrigeration system 10 is in a cooling mode, the set temperature is less than the indoor space temperature by at least a threshold (for example, 10° F. less than the indoor space temperature), and the ambient temperature is greater than the set temperature plus a threshold (for example, when the ambient temperature is within a range of 20° F. or greater than the set temperature). Alternatively, the operation mode module 202 may determine a cooling-hybrid operation mode when the refrigeration system 10 is in a cooling mode, the set temperature is less than the indoor space temperature by at least a threshold (for example, 10° F. less than the indoor space temperature), and the ambient temperature is greater than a predetermined threshold (for example, when the ambient temperature is greater than 100° F.). Alternatively, the operation mode module 202 may determine a cooling-hybrid operation mode when the refrigeration system 10 is in a cooling mode and the set temperature is less than the indoor space temperature by at least a threshold (for example, 10° F. less than the indoor space temperature). Alternatively, the operation mode module 202 may determine a cooling-hybrid operation mode when the refrigeration system 10 is in a cooling mode and the set temperature is less than the indoor space temperature, the cold TES 122 is not fully charged and higher cooling loads or higher electricity prices are expected in the next few hours.

The operation mode module 202 may determine a heating-hybrid operation mode when the refrigeration system 10 is in a heating mode, the set temperature is greater than the indoor space temperature by at least a threshold (for example, 10° F. greater than the indoor space temperature), and the ambient temperature is less than the set temperature plus a threshold (for example, when the ambient temperature is within a range of 40° F. or less than the set temperature). Alternatively, the operation mode module 202 may determine a heating-hybrid operation mode when the refrigeration system 10 is in a heating mode, the set temperature is greater than the indoor space temperature by at least a threshold (for example, 10° F. greater than the indoor space temperature), and the ambient temperature is less than a predetermined threshold (for example, when the ambient temperature is less than 30° F.). Alternatively, the operation mode module 202 may determine a heating-hybrid operation mode when the refrigeration system 10 is in a heating mode and the set temperature is greater than the indoor space temperature by at least a threshold (for example, 20° F. greater than the indoor space temperature). Alternatively, the operation mode module 202 may determine a heating-hybrid operation mode when the refrigeration system 10 is in a heating mode and the set temperature is greater than the indoor space temperature, the hot TES 54 is not fully charged and higher heating loads or higher electricity prices are expected in the next few hours.

When the operation mode module 202 determines an operation mode for the refrigeration system 10, the operation mode module 202 outputs position commands to the multi-position valve 46, the multi-position valve 114, and the valve 102. Additionally, the operation mode module 202 outputs operation commands to the compressor 26 the expansion valve 34, the indoor coil 106, and the outdoor coil 110.

Figure 18A:
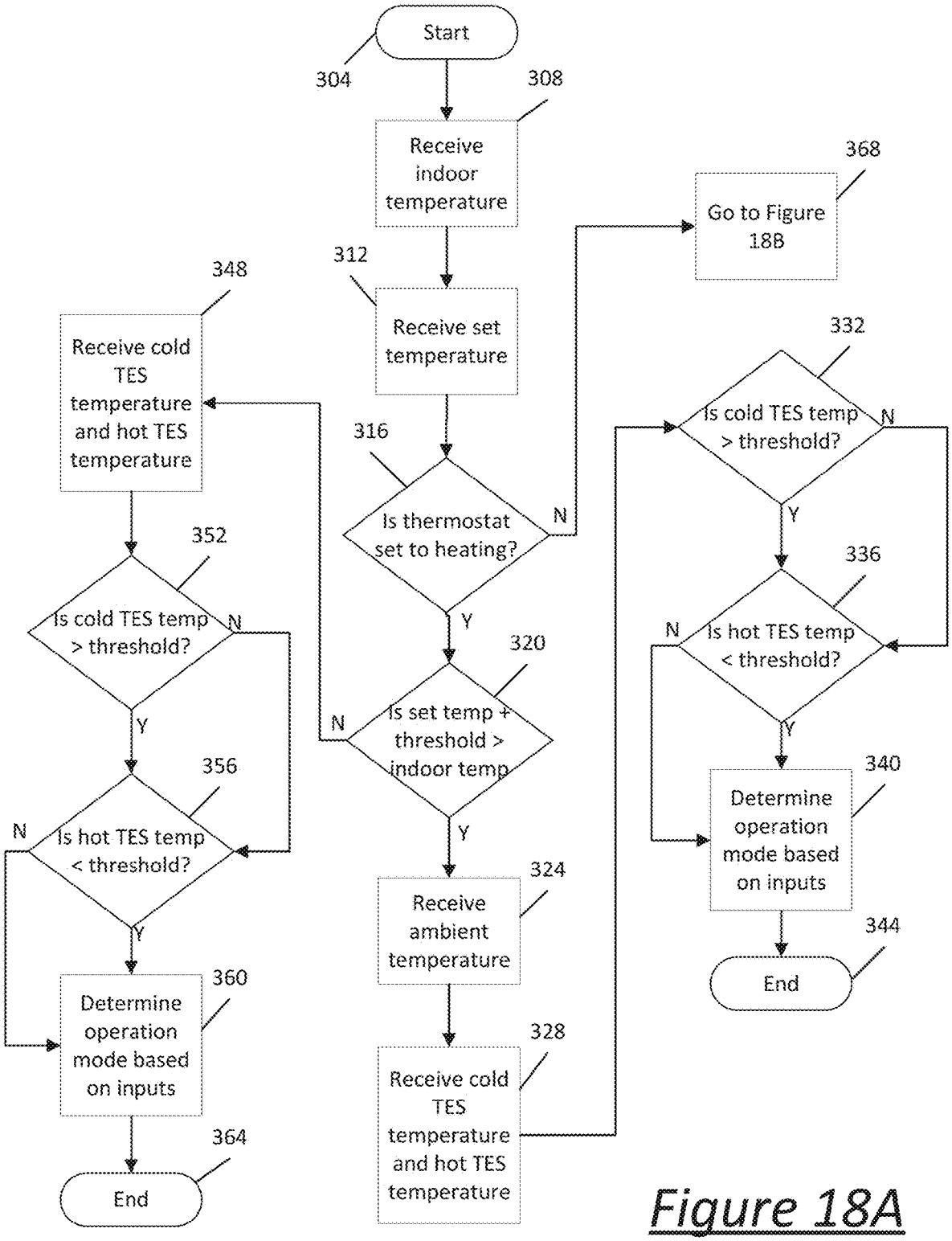
FIGS. 18A-18C is a flow chart for a method of controlling the refrigeration system in FIG. 1.
Figure 18B:
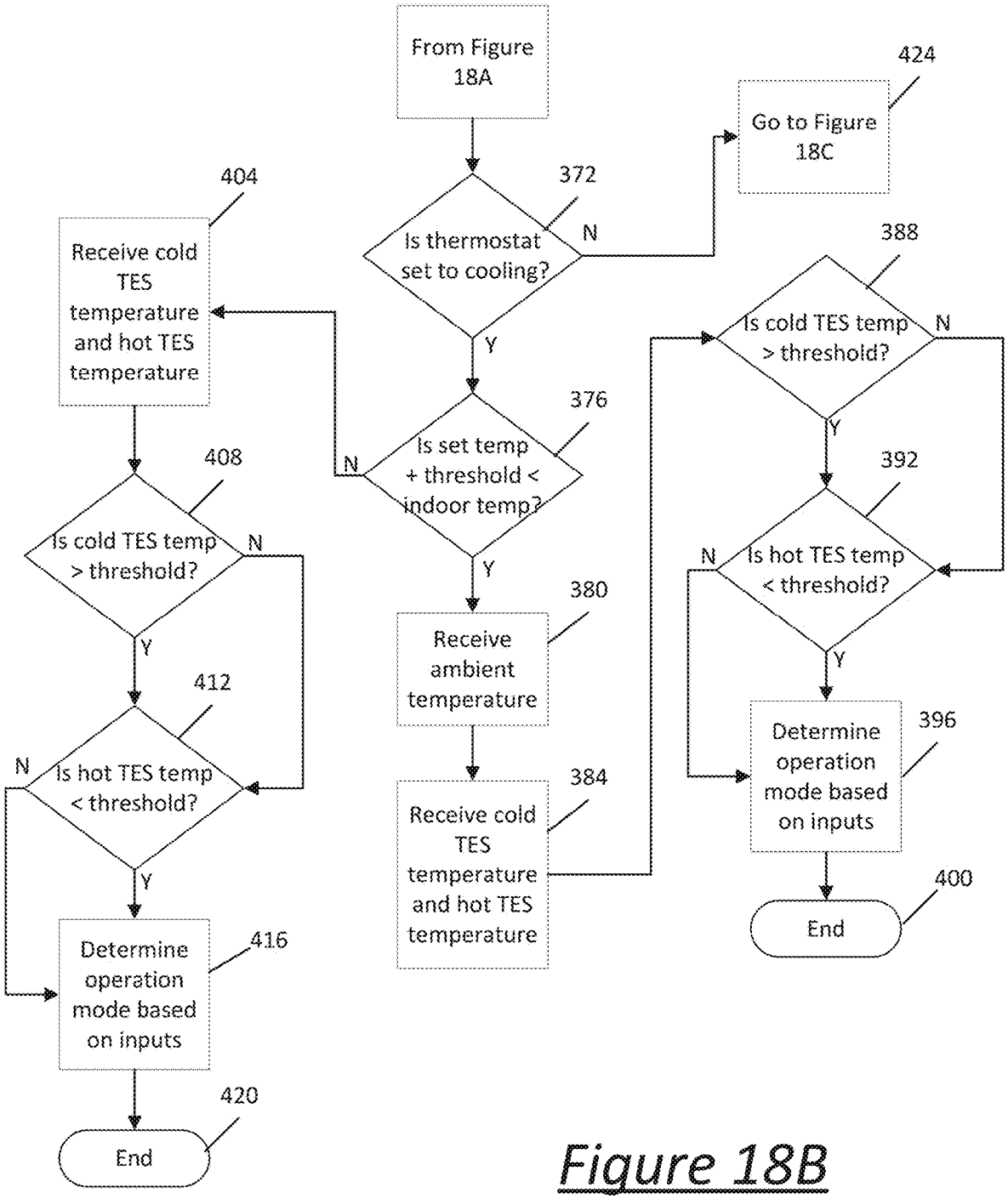
Figure 18C:
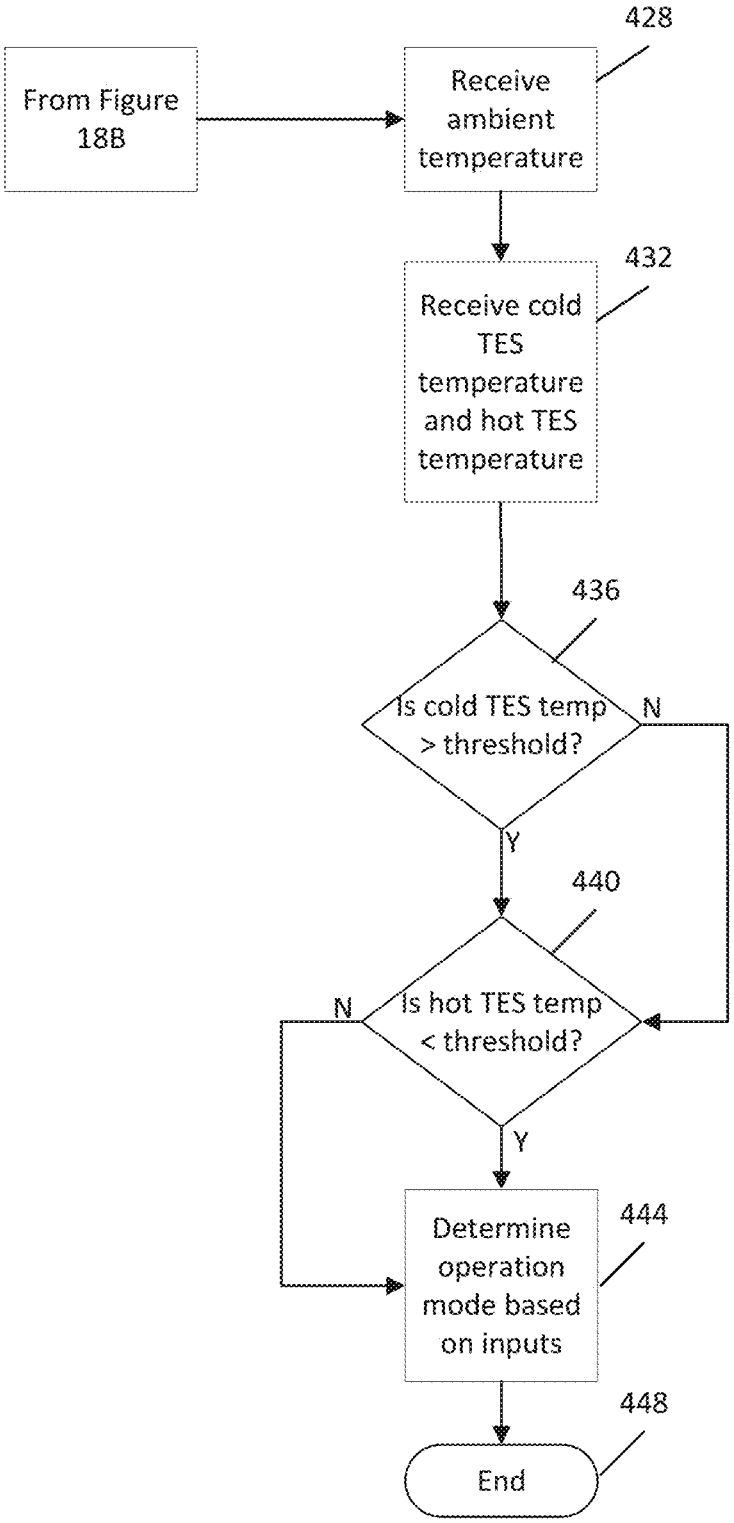

Referring to FIGS. 18A-18C, a flow chart for a method 300 of controlling a refrigeration system 10 is illustrated. The method 300 may be executed by the system controller 42 and the refrigeration system 10 components. Method 300 begins at 304. At 308, the system 10 receives an indoor space temperature. For example, the system controller 42 may receive the indoor space temperature. The indoor space temperature may be provided by a sensor in the indoor space.

At 312, the system 10 receives a set temperature. For example, the system controller 42 may receive the set temperature. The set temperature may be provided by a user input.

At 316, the system 10, and more specifically, the system controller 42, determines whether the thermostat is set to heating. The system controller 42 may evaluate a user input to determine whether the thermostat is in a heating mode. If true, the method moves to 320.

At 320, the system 10, and more specifically the system controller 42, determines whether the set temperature (plus a threshold) is greater than the indoor space temperature. For example, the threshold may be within a range of 1-2° F. less than the set temperature. If true, method 300 moves to 324.

At 324, the system 10, and more specifically the system controller 42, receives an ambient temperature. For example, the ambient temperature may be provided by a sensor in an outdoor environment outside of the indoor space.

At 328, the system 10, and more specifically the system controller 42, receives a cold TES 122 temperature and a hot TES 54 temperature. For example, the cold TES 122 temperature and the hot TES 54 temperature may be provided by sensors in the cold TES tank 170 and the hot TES tank 98, respectively. Alternatively, for example, the cold TES 122 temperature and the hot TES 54 temperature may be provided by sensors in the cold TES inlet fluid line 134 and hot TES inlet fluid line 66, respectively. Alternatively, for example, the cold TES 122 temperature and the hot TES 54 temperature may be provided by sensors in the cold TES outlet fluid line 138 and hot TES outlet fluid line 70, respectively.

At 332, the system 10, and more specifically the system controller 42, determines whether the cold TES 122 temperature is greater than a threshold. For example, the threshold may be within a range of 40° F.-60° F. If true at 332, the method 300 moves to 336. If false at 332, method 300 moves to 336.

At 336, the system 10, and more specifically the system controller 42, determines whether the hot TES 54 temperature is less than a threshold. For example, the threshold may be within a range of 80° F.-110° F. If true at 336, the method 300 moves to 340. If false at 336, method 300 moves to 340.

At 340, the system 10, and more specifically the system controller 42, determines an operation mode based on the inputs. For example, the system controller 42 may select between the following operation modes: heating-traditional operation mode, heating-charging cold TES operation mode, heating-cold day operation mode, heating-hybrid operation mode, charging both TES operation mode, and charging hot water tank operation mode.

Method 300 ends at 344. Alternatively, method 300 may return to 304.

If false at 320, method 300 moves to 348. At 348, the system 10, and more specifically the system controller 42 receives a cold TES 122 temperature and a hot TES 54 temperature. For example, the cold TES 122 temperature and the hot TES 54 temperature may be provided by sensors in the cold TES tank 170 and the hot TES tank 98, respectively. Alternatively, for example, the cold TES 122 temperature and the hot TES 54 temperature may be provided by sensors in the cold TES inlet fluid line 134 and hot TES inlet fluid line 66, respectively. Alternatively, for example, the cold TES 122 temperature and the hot TES 54 temperature may be provided by sensors in the cold TES outlet fluid line 138 and hot TES outlet fluid line 70, respectively.

At 352, the system 10, and more specifically the system controller 42, determines whether the cold TES 122 temperature is greater than a threshold. For example, the threshold may be within a range of 40° F.-60° F. If true at 352, the method 300 moves to 356. If false at 352, method 300 moves to 356.

At 356, the system 10, and more specifically the system controller 42, determines whether the hot TES 54 temperature is less than a threshold. For example, the threshold may be within a range of 80° F.-110° F. If true at 356, the method 300 moves to 360. If false at 356, method 300 moves to 360.

At 360, the system 10, and more specifically the system controller 42, determines an operation mode based on the inputs. For example, the system controller 42 may select between the following operation modes: heating-traditional operation mode, heating-charging cold TES operation mode, heating-cold day operation mode, heating-hybrid operation mode, charging both TES operation mode, and charging hot water tank operation mode.

Method 300 ends at 364. Alternatively, method 300 may return to 304.

If false at 316, the method moves to 368.

At 372 (FIG. 18B), the system 10, and more specifically, the system controller 42, determines whether the thermostat is set to cooling. The system controller 42 may evaluate a user input to determine whether the thermostat is in a cooling mode. If true the method moves to 376.

At 376, the system 10, and more specifically the system controller 42, determines whether the set temperature (plus a threshold) is less than the indoor space temperature. For example, the threshold may be within a range of 1-2° F. greater than the set temperature. If true, method 300 moves to 380.

At 380, the system 10, and more specifically the system controller 42, receives an ambient temperature. For example, the ambient temperature may be provided by a sensor in an outdoor environment outside of the indoor space.

At 384, the system 10, and more specifically the system controller 42, receives a cold TES 122 temperature and a hot TES 54 temperature. For example, the cold TES 122 temperature and the hot TES 54 temperature may be provided by sensors in the cold TES tank 170 and the hot TES tank 98, respectively. Alternatively, for example, the cold TES 122 temperature and the hot TES 54 temperature may be provided by sensors in the cold TES inlet fluid line 134 and hot TES inlet fluid line 66, respectively. Alternatively, for example, the cold TES 122 temperature and the hot TES 54 temperature may be provided by sensors in the cold TES outlet fluid line 138 and hot TES outlet fluid line 70, respectively.

At 388, the system 10, and more specifically the system controller 42, determines whether the cold TES 122 temperature is greater than a threshold. For example, the threshold may be within a range of 40° F.-60° F. If true at 388, the method 300 moves to 392. If false at 388, method 300 moves to 392.

At 392, the system 10, and more specifically the system controller 42, determines whether the hot TES 54 temperature is less than a threshold. For example, the threshold may be within a range of 80° F.-110° F. If true at 392, the method 300 moves to 396. If false at 392, method 300 moves to 396.

At 396, the system 10, and more specifically the system controller 42, determines an operation mode based on the inputs. For example, the system controller 42 may select between the following operation modes: cooling-traditional operation mode, cooling-TES charging operation mode, cooling-TES discharging operation mode, charging both TES operation mode, charging hot water tank operation mode, and cooling-hybrid operation mode.

Method 300 ends at 400. Alternatively, method 300 may return to 304.

If false at 376, method 300 moves to 404. At 404, the system 10, and more specifically the system controller 42 receives a cold TES 122 temperature and a hot TES 54 temperature. For example, the cold TES 122 temperature and the hot TES 54 temperature may be provided by sensors in the cold TES tank 170 and the hot TES tank 98, respectively. Alternatively, for example, the cold TES 122 temperature and the hot TES 54 temperature may be provided by sensors in the cold TES inlet fluid line 134 and hot TES inlet fluid line 66, respectively. Alternatively, for example, the cold TES 122 temperature and the hot TES 54 temperature may be provided by sensors in the cold TES outlet fluid line 138 and hot TES outlet fluid line 70, respectively.

At 408, the system 10, and more specifically the system controller 42, determines whether the cold TES 122 temperature is greater than a threshold. For example, the threshold may be within a range of 40° F.-60° F. If true at 408, the method 300 moves to 412. If false at 408, method 300 moves to 412.

At 412, the system 10, and more specifically the system controller 42, determines whether the hot TES 54 temperature is less than a threshold. For example, the threshold may be within a range of 80° F.-110° F. If true at 412, the method 300 moves to 416. If false at 412, method 300 moves to 416.

At 416, the system 10, and more specifically the system controller 42, determines an operation mode based on the inputs. For example, the system controller 42 may select between the following operation modes: cooling-traditional operation mode, cooling-TES charging operation mode, cooling-TES discharging operation mode, charging both TES operation mode, charging hot water tank operation mode, and cooling-hybrid operation mode.

Method 300 ends at 420. Alternatively, method 300 may return to 304.

If false at 372, method 300 moves to 424. At 428 (FIG. 18C), the system 10, and more specifically the system controller 42, receives an ambient temperature. For example, the ambient temperature may be provided by a sensor in an outdoor environment outside of the indoor space.

At 432, the system 10, and more specifically the system controller 42, receives a cold TES 122 temperature and a hot TES 54 temperature. For example, the cold TES 122 temperature and the hot TES 54 temperature may be provided by sensors in the cold TES tank 170 and the hot TES tank 98, respectively. Alternatively, for example, the cold TES 122 temperature and the hot TES 54 temperature may be provided by sensors in the cold TES inlet fluid line 134 and hot TES inlet fluid line 66, respectively. Alternatively, for example, the cold TES 122 temperature and the hot TES 54 temperature may be provided by sensors in the cold TES outlet fluid line 138 and hot TES outlet fluid line 70, respectively.

At 436, the system 10, and more specifically the system controller 42, determines whether the cold TES 122 temperature is greater than a threshold. For example, the threshold may be within a range of 40° F.-60° F. If true at 436, the method 300 moves to 440. If false at 436, method 300 moves to 440.

At 440, the system 10, and more specifically the system controller 42, determines whether the hot TES 54 temperature is less than a threshold. For example, the threshold may be within a range of 80° F.-110° F. If true at 440, the method 300 moves to 444. If false at 440, method 300 moves to 444.

At 444, the system 10, and more specifically the system controller 42, determines an operation mode based on the inputs. For example, the system controller 42 may select between the following operation modes: charging both TES operation mode and charging hot water tank operation mode.

Method 300 ends at 448. Alternatively, method 300 may return to 304.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A refrigeration system comprising:

a main fluid loop through which a first working fluid circulates, the main fluid loop including a compressor and a heat exchanger; and a secondary fluid loop through which a second working fluid circulates, the secondary fluid loop being in thermal communication with the main fluid loop at the heat exchanger, wherein the secondary fluid loop includes a first pump, a thermal energy storage, and a coil fluid line, wherein the secondary fluid loop includes a first multi-position valve configured to move between positions that selectively fluidly connect the heat exchanger, the pump, the thermal energy storage, and the coil fluid line, wherein the secondary fluid loop is a heating secondary fluid loop, the thermal energy storage is a hot thermal energy storage, the coil fluid line is a heating coil fluid line, wherein the refrigeration system further comprises a cooling secondary fluid loop through which a third working fluid circulates, the cooling secondary fluid loop including a second pump, a cold thermal energy storage, and a cooling coil fluid line, and wherein the refrigeration system further comprises a connection valve, an indoor coil, and an outdoor coil, wherein the connection valve selectively connects the heating coil fluid line and the cooling coil fluid line with the indoor coil and the outdoor coil.

2. The refrigeration system of claim 1, wherein the heat exchanger is a condenser.

3. The refrigeration system of claim 2, wherein:

the main fluid loop includes an evaporator through which the first working fluid circulates, and the cooling secondary fluid loop is in thermal communication with the main fluid loop at the evaporator.

4. The refrigeration system of claim 3, wherein the cooling secondary fluid loop includes a second multi-position valve configured to rotate between positions that selectively fluidly connect the evaporator, the second pump, the cold thermal energy storage, and the cooling coil fluid line.

5. The refrigeration system of claim 3, wherein the second working fluid is the same as the third working fluid.

6. The refrigeration system of claim 5, wherein the first working fluid is different from the second working fluid.

7. The refrigeration system of claim 1, wherein the first working fluid is different from the second working fluid.

8. The refrigeration system of claim 1, wherein the first working fluid includes a low global warming potential (LGWP) refrigerant.

9. The refrigeration system of claim 1, wherein the second working fluid includes a non-flammable refrigerant.

10. The refrigeration system of claim 1, wherein the heat exchanger is a brazed-plate heat exchanger.

11. A refrigeration system comprising:

a main fluid loop through which a first working fluid circulates, the main fluid loop including a compressor and a heat exchanger;

a secondary fluid loop through which a second working fluid circulates, the secondary fluid loop being in thermal communication with the main fluid loop at the heat exchanger, wherein the secondary fluid loop includes a pump, a thermal energy storage, and a coil fluid line;

a multi-position valve comprising:

an actuator;

a plurality of passages;

a pump inlet; and a pump outlet, wherein the actuator is configured to rotate the plurality of passages, the pump inlet, and the pump outlet to selectively fluidly connect the heat exchanger, the pump, the thermal energy storage, and the coil fluid line, wherein the multi-position valve is movable between a first position, a second position, a third position, and a fourth position, wherein, in the first position, the multi-position valve allows a coil to be heated by pumping the second working fluid from the thermal energy storage to the coil and by pumping the second working fluid from the coil through the pump, wherein, in the second position, the multi-position valve allows a condenser to heat the thermal energy storage and allows the thermal energy storage to heat the coil, wherein, in the third position, the multi-position valve allows the thermal energy storage to be heated and charged by the condenser, and wherein, in the fourth position, the multi-position valve allows the condenser to be fluidly connected to and heat the coil.

12. The refrigeration system of claim 11, wherein the plurality of passages extend orthogonal to an axis through the pump inlet and an axis through the pump outlet.

13. The refrigeration system of claim 11, wherein the plurality of passages extend orthogonal to a rotation axis of the actuator.

14. A method for controlling a refrigeration system, the method comprising:

receiving, by a controller, a user input and a sensor input, wherein the sensor input is received from a temperature sensor and is indicative of an indoor space temperature;

determining an operating mode for a main fluid loop and a secondary fluid loop based on the user input and the sensor input, wherein the main fluid loop includes a compressor and a heat exchanger, wherein a first working fluid circulates through the main fluid loop, wherein the secondary fluid loop includes a pump, a thermal energy storage, and a coil fluid line, wherein a second working fluid circulates through the secondary fluid loop, wherein the secondary fluid loop is a heating secondary fluid loop, wherein the thermal energy storage is a hot thermal energy storage, and wherein the coil fluid line is a heating coil fluid line;

controlling, by the controller, the main fluid loop based on the operating mode;

controlling, by the controller, the secondary fluid loop based on the operating mode;

actuating, by the controller, a multi-position valve in the secondary fluid loop based on the operating mode between positions that selectively fluidly connect the heat exchanger, the pump, the thermal energy storage, and the coil fluid line;

controlling, by the controller, a cooling secondary fluid loop based on the operating mode, the cooling secondary fluid loop including a pump, a cold thermal energy storage, and a cooling coil fluid line; and actuating, by the controller, a connection valve based on the operating mode, wherein the connection valve selectively connects the heating coil fluid line and the cooling coil fluid line with an indoor coil and an outdoor coil.

15. The method of claim 14, wherein the heat exchanger is a condenser, and wherein the main fluid loop includes an evaporator.

16. The method of claim 15, further comprising:

actuating, by the controller, a multi-position valve in the cooling secondary fluid loop based on the operating mode between positions that selectively fluidly connect the evaporator, the pump, the cold thermal energy storage, and the cooling coil fluid line.

17. The method of claim 14, wherein the first working fluid includes a low global warming potential (LGWP) refrigerant and the second working fluid includes a non-flammable refrigerant.

* * * * *